US009421800B2

(12) United States Patent
Okuda et al.

(10) Patent No.: US 9,421,800 B2
(45) Date of Patent: Aug. 23, 2016

(54) IMAGE FORMING APPARATUS

(71) Applicant: CANON FINETECH INC., Misato-shi (JP)

(72) Inventors: Takahiro Okuda, Tokyo (JP); Takehiro Sato, Chiba-shi (JP)

(73) Assignee: CANON FINETECH INC., Misato-shi (JP)

( * ) Notice: Subject to any disclaimer, the term of this patent is extended or adjusted under 35 U.S.C. 154(b) by 0 days.

(21) Appl. No.: 14/474,658

(22) Filed: Sep. 2, 2014

(65) Prior Publication Data

US 2015/0070457 A1 Mar. 12, 2015

(30) Foreign Application Priority Data

Sep. 6, 2013 (JP) ..... 2013-185325

(51) Int. Cl.

| | |
|---|---|
| ***B41J 29/13*** | (2006.01) |
| ***B41J 25/34*** | (2006.01) |
| ***B41J 11/58*** | (2006.01) |
| ***B41J 11/00*** | (2006.01) |
| *B41J 2/175* | (2006.01) |

(52) U.S. Cl.

CPC ..... *B41J 25/34* (2013.01); *B41J 11/006* (2013.01); *B41J 11/007* (2013.01); *B41J 11/58* (2013.01); *B41J 2/1752* (2013.01); *B41J 2/17513* (2013.01)

(58) Field of Classification Search

CPC ..... B41J 29/13; B41J 29/02; B41J 2/1752; B41J 29/38; B41J 2/17513; B41J 25/34

See application file for complete search history.

(56) References Cited

U.S. PATENT DOCUMENTS

| | | | | |
|---|---|---|---|---|
| 8,328,443 | B2 | 12/2012 | Kawabe et al. | |
| 9,090,103 | B2 | 7/2015 | Sakano | |
| 2003/0031480 | A1 | 2/2003 | Miura | |
| 2009/0218761 | A1 * | 9/2009 | Sakano | B41J 11/006 271/264 |
| 2010/0007081 | A1 | 1/2010 | Miki | |
| 2011/0115866 | A1 * | 5/2011 | Izuma et al. | 347/104 |
| 2011/0279541 | A1 * | 11/2011 | Kida | B41J 2/515 347/37 |

FOREIGN PATENT DOCUMENTS

| | | | |
|---|---|---|---|
| EP | 2 281 764 | A2 | 2/2011 |
| JP | 2005-326683 | A | 11/2005 |
| JP | 2009-190172 | A | 8/2009 |

(Continued)

OTHER PUBLICATIONS

European Search Report dated Feb. 27, 2015, in related European Patent Application No. 14183653.6.

(Continued)

*Primary Examiner* — Lisa M Solomon

(74) *Attorney, Agent, or Firm* — Fitzpatrick, Cella, Harper & Scinto

(57) ABSTRACT

An image forming apparatus includes a moving portion that moves a printing medium, with the moving portion capable of being mounted to the image forming apparatus, an image forming portion that ejects ink droplets to the printing medium that is moved by the moving portion and forms an image thereon, and a reference portion mounted to the image forming apparatus. In addition, a positioning portion forces the moving portion, mounted to the image forming apparatus, to abut against the reference portion so that a distance between the moving portion and the image forming portion is a predetermined distance.

16 Claims, 21 Drawing Sheets

(56) References Cited

FOREIGN PATENT DOCUMENTS

| | | | |
|---|---|---|---|
| JP | 2010-018406 | A | 1/2010 |
| JP | 2010-105811 | A | 5/2010 |
| JP | 2011-197355 | A | 10/2011 |
| JP | 2011-212886 | A | 10/2011 |

OTHER PUBLICATIONS

Japanese Office Action dated Jul. 28, 2015, in related Japanese Patent Application No. 2013-185325.

* cited by examiner

IMAGE FORMING APPARATUS

BACKGROUND OF THE INVENTION

1. Field of the Invention

The present invention relates to an image forming apparatus that employs an image forming portion to form an image on a printing medium that is conveyed by a conveying portion.

2. Description of the Related Art

At present, image forming apparatuses that can form images on various types of printing media have been developed, and have been used in various different fields. These image forming apparatuses are also very frequently employed as, for example, coupon printers or small commodity label printers, for limited applications. Therefore, for installing the image forming apparatus, not only a usual desktop area, but also a shelf or another location tends to be selected in accordance with the use.

Since various applications and the installation locations can be selected, the situation where there is a restriction on the space for installing the image forming apparatus has also occurred. For example, in a printing apparatus wherein the cover portion needs to be pivoted upward to clear a paper jam, a space for allowing the upward movement of the lid must be obtained. Further, in a case wherein a location where the image forming apparatus must be moved when sheets are to be loaded is selected, there is a restriction that space for moving the image forming apparatus should be obtained near the installation location.

There is a proposal for reducing the installation space, and according to this proposal, one part of the conveying part that conveys a printing medium to a discharge part is to be extracted in one direction (e.g., in a direction in which the printing medium is to be discharged), and the space required to perform a paper jam clearing process and a sheet setting process is limited only to the front of the apparatus. In Japanese Patent Laid-Open NO. 2010-18406, for example, an apparatus where a sheet cassette is to be pulled out in a paper discharge direction is disclosed.

However, in the arrangement wherein the sheet cassette and the conveying part are to be extracted in one specific direction, the accuracy for positioning the sheet cassette and the conveying part in the conveying direction can be easily obtained, but the positioning accuracy in the vertical direction is difficult. When the satisfactory vertical positioning accuracy is not obtained, there is a possibility that sheet feeding, conveying and image forming may not be appropriately performed. Especially, the vertical positioning accuracy is reduced for the conveying part, the position relative to the image forming unit is deviated, and this deviation greatly affects the image quality.

SUMMARY OF THE INVENTION

While taking the above described shortcomings into account, one objective of the present invention is to provide an image forming apparatus wherein a medium moving portion that can be extracted from, and mounted to, the main body of the apparatus can be very accurately positioned.

In order to achieve this objective, the present invention includes the following arrangement.

Specifically, according to a first aspect of this invention, an image forming apparatus comprises:

a moving portion that moves a printing medium;

an image forming portion that ejects ink droplets to the printing medium that is moved by the moving portion, and forms an image thereon;

a supporting portion that supports the image forming portion, and supports the moving portion so as to be extracted from, or mounted to the supporting portion; and an abutment mechanism that forces the moving portion, mounted to the supporting portion, to move toward the image forming portion and abut on a reference portion.

According to the present invention, for the image forming apparatus wherein the moving portion that moves the printing medium can be extracted from, or mounted to the image forming portion, the moving portion can be very accurately positioned relative to the image forming portion.

Further features of the present invention will become apparent from the following description of exemplary embodiments (with reference to the attached drawings).

DESCRIPTION OF THE EMBODIMENTS

Figure 1:
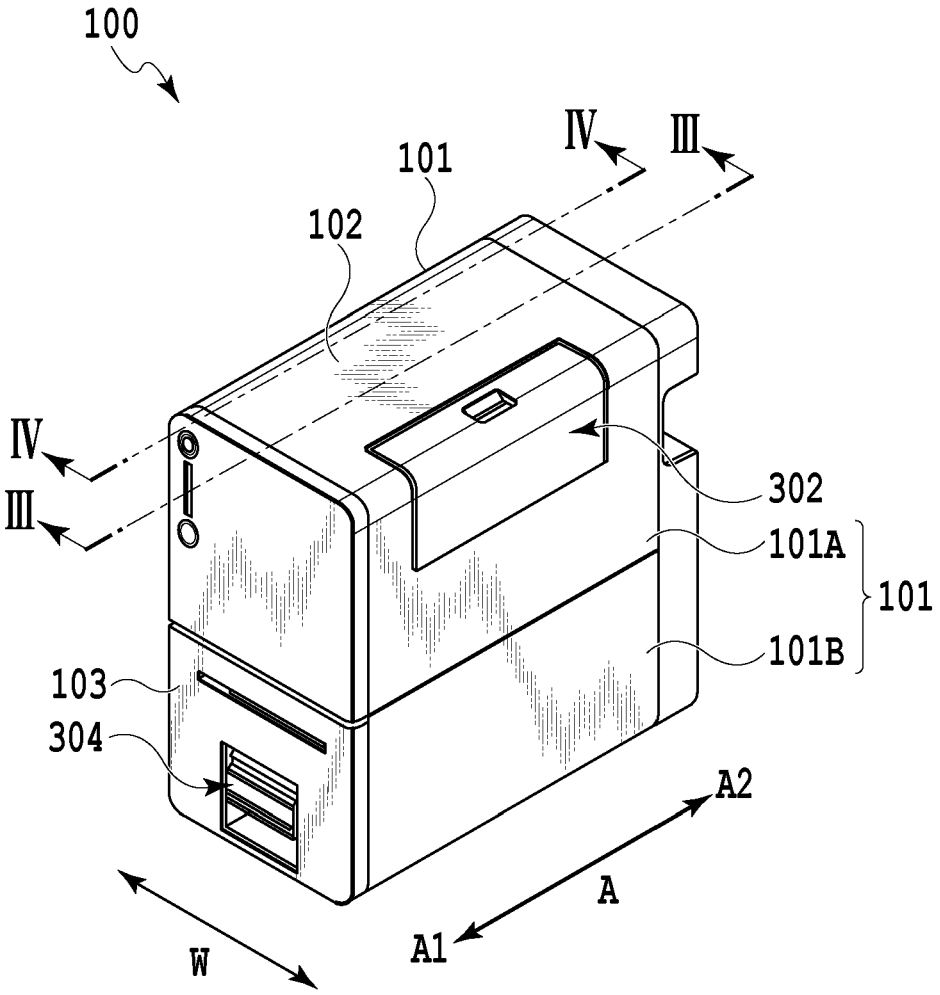
FIG. 1 is a perspective view of the external appearance of an image forming apparatus according to a first embodiment of the present invention.

The embodiments of the present invention will now be specifically described while referring to drawings. The same reference numerals are employed for all of the drawings to denote the identical or corresponding portions.

(First Embodiment)

FIG. 1 is a perspective view of the external appearance of an image forming apparatus according to a first embodiment of the present invention. For an image forming apparatus 100 for the first embodiment, an image forming unit 102 to be described later and a conveying unit 103 that serves as a medium moving unit for moving a printing medium SH are arranged inside an image forming apparatus main body (hereinafter referred to as a main body) 101 that serves as an outer cover for the image forming apparatus 100. The main body 101 of this embodiment includes a first housing 101A where the image forming unit 102 is stored and a second housing 101B where the conveying unit 103 is to be accepted. The image forming unit 102 is held and fixed at a specified location in the first housing 101A of the main body 101, while the conveying unit 103 is arranged to be extracted from, or inserted into the second housing 101B of the main body 101. The state in FIG. 2 shows when the conveying unit 103 is removed from the main body 101 of the image forming apparatus 100, and the conveying unit 103 thus extracted can be carried to an arbitrary place at a distance from the place where the main body 101 is installed.

Figure 2:
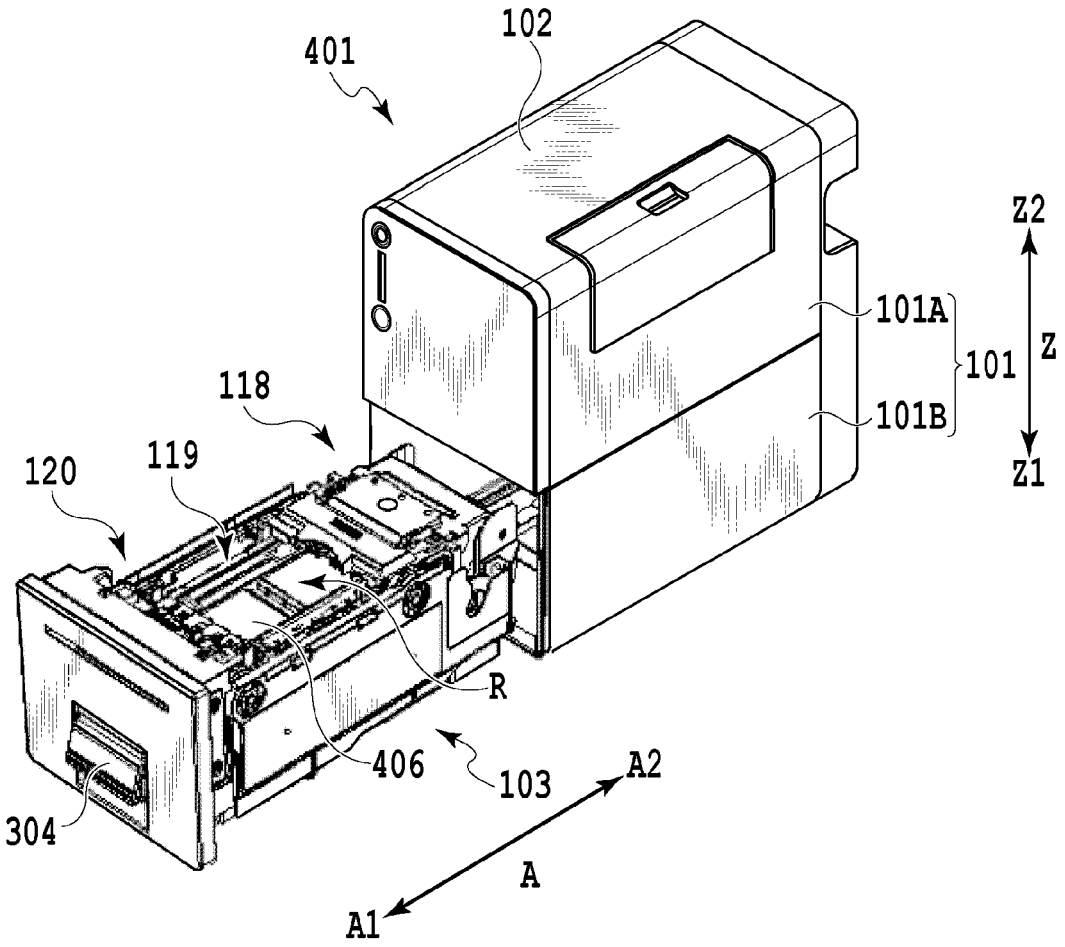
FIG. 2 is a perspective view of the image forming apparatus in FIG. 1 from which a conveying unit is removed.

As shown in FIG. 2, the conveying unit 103 includes: a feeding part 118 that feeds the printing medium SH to a conveying path R along a platen 406; a conveying part 119 that conveys, in a conveying direction A1, the printing medium SH that is fed to the conveying path R; and a discharge part 120 that discharges the printing medium SH to the outside of the conveying unit 103. When the conveying unit 103 is to be removed from the main body 101, first, a conveying lever 304 is pulled and turned down. Then, the conveying unit 103 is pulled forward (the conveying direction A1) by holding the conveying lever 304, so that the conveying unit 103 is extracted from the main body 101 in the direction A1 in which the printing medium SH is to be conveyed. In FIG. 2, A represents a direction in which the conveying unit 103 can be moved relative to the main body 101. The conveying unit 103 can be completely separated from the main body 101. Therefore, when the jam of the printing medium SH occurs, a user can obtain a large space area to clear the jam.

When the conveying unit 103 has been inserted into the main body 101 as shown in FIG. 1, the conveying unit 103 is connected to a main board 201 (see FIG. 4) by a drawer connector 117 (see FIG. 3), and electric power required for driving the individual sections, such as a conveying motor 115 (see FIG. 3) and a roll drive motor 116 (also see FIG. 3), is supplied by the main board 201. When the conveying unit 103 is to be extracted from the main body 101, the conveying lever 304 is pulled in the above described manner, and a conveyance ON/OFF detecting switch 121 (see FIG. 3) internally provided for the conveying lever 304 cuts off the supply of power from the power source to the conveying unit 103. As a result, a phenomenon (hot swapping) that the conveying unit 103 is removed by a user while the power is running through the conveying unit 103 can be prevented. The discharge part 120 includes a discharge port and a cutter unit that cuts off the portion of the printing medium SH that is discharged from the discharge port.

Figure 3:
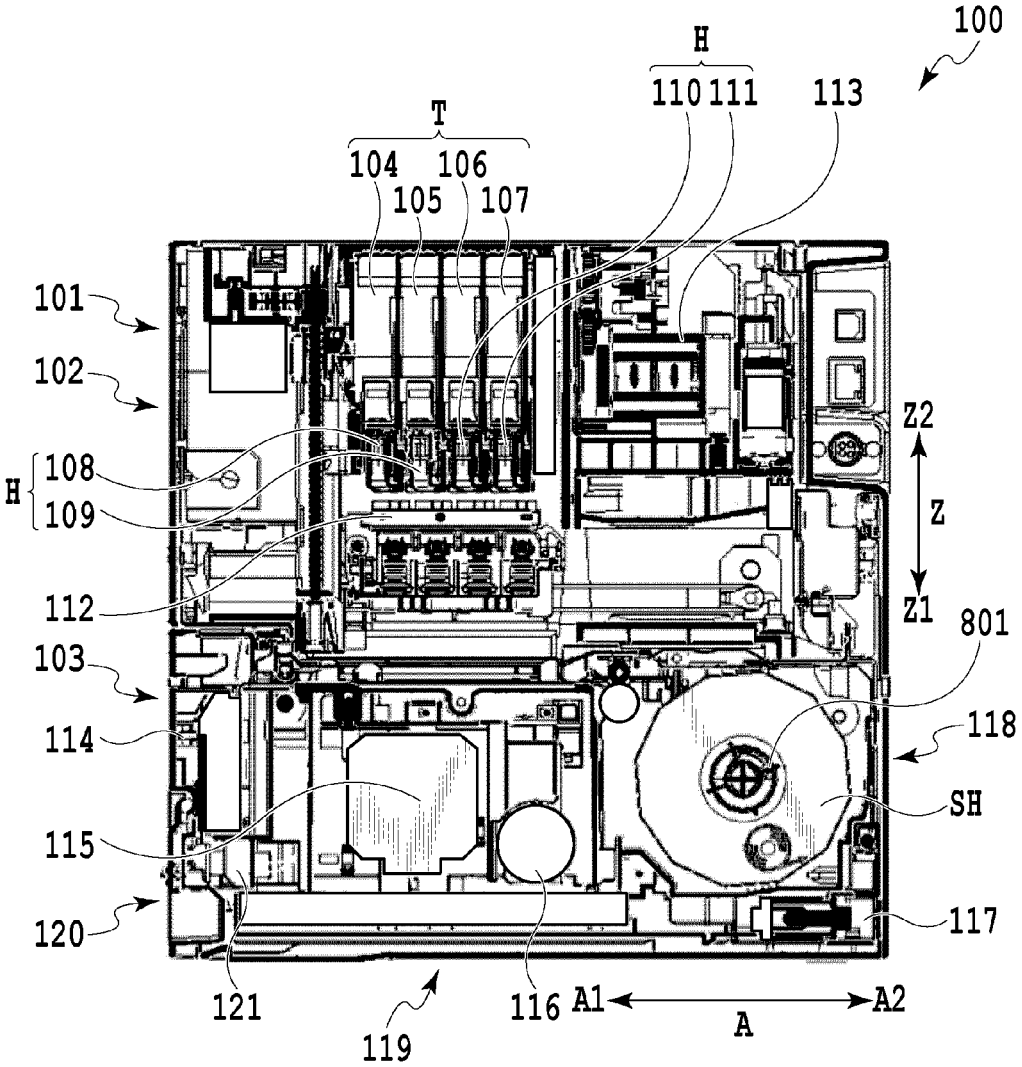
FIG. 3 is a cross-sectional view taken along line III-III in FIG. 1.
Figure 4:
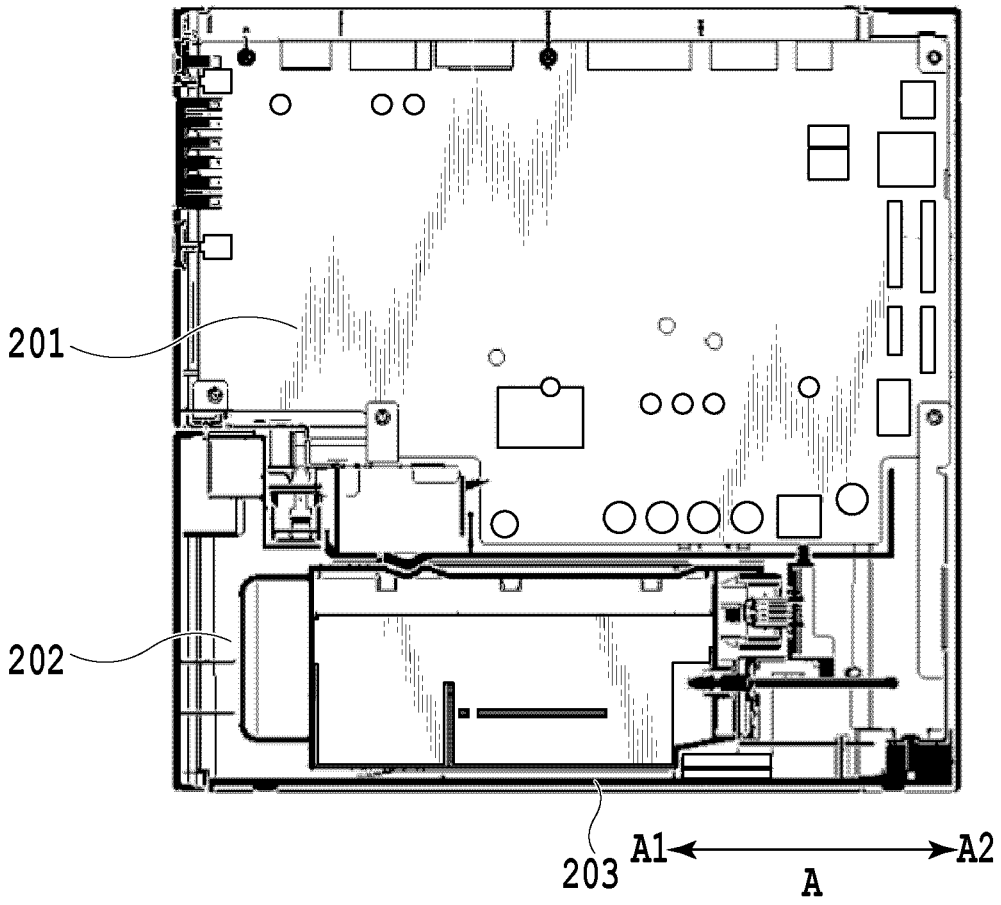
FIG. 4 is a cross-sectional view taken along line IV-IV in FIG. 1.

Next, the internal arrangement of the image forming apparatus 100 of this embodiment will be described while referring to FIGS. 3 and 4. FIG. 3 is a cross-sectional view taken along line III-III in FIG. 1, and FIG. 4 is a cross-sectional view taken along line IV-IV in FIG. 1. The image forming apparatus 100 employed for this embodiment is an ink jet printing apparatus that ejects ink from ink jet print heads to form an image. Further, in the specification of this invention, the side of the main body 101 where the conveying lever 304 in FIG. 1 and the discharge port are provided serves as a manipulation side that is to be operated by a user (the front side of the image forming apparatus 100). Further, a left side L of the image forming apparatus 100 represents the rear side shown in FIGS. 3 and 4, and a right side R represents the front side in FIGS. 3 and 4.

For the image forming apparatus 100 of this embodiment, long paper provided in a rolled form is employed as the printing medium SH; however, Z-fold paper or fanfold paper can also be employed as a printing medium SH, or cut sheets may also be employed. The available sheet size ranges from one inch wide to 63 mm wide, and various types of paper, such as glossy paper, matte paper and synthetic paper, can also be employed. For setting the printing medium SH, the left side L (see FIG. 1) with respect to the discharge side (operation side) of the image forming apparatus 100 is employed as a reference. It should be noted that the printing medium SH employed for this embodiment includes continuous belt-shaped backing paper and a plurality of labels that are adhered to one side of the backing paper at predetermined intervals in the longitudinal direction.

As described above, the image forming apparatus 100 includes the image forming unit 102 and the conveying unit 103, and also includes the main board 201 located on the left side L of the image forming unit 102 and a maintenance cartridge 202 provided below the image forming unit 102. The image forming unit 102 includes ink tanks 104 to 107, print heads 108 to 111, a recovery tub 112 that serves as a cap for covering the ejection ports of the print heads 108 to 111, and a pump unit 113.

Of the four ink tanks, the ink tank 104 is used to store yellow (Y) ink, the ink tank 105 is used to store magenta (M) ink, the ink tank 106 is used to store cyan (C) ink, and the ink tank 107 is used to store black (BK) ink. The individual ink tanks 104 to 107 are correlated respectively with the print heads 108 to 111. Specifically, ink in the ink tank 104 is supplied to the print head 108, ink in the ink tank 105 is supplied to the print head 109, ink in the ink tank 106 is supplied to the print head 110 and the ink in the ink tank 107 is supplied to the print head 111. In the following description, the ink tanks 104 to 107 are collectively referred to as ink tanks T and the print heads 108 to 111 are collectively referred to as print heads H, unless the individual ink tanks and the print heads need be particularly identified.

The individual print heads H are ink jet print heads, each of which prints an image on the printing medium SH by ejecting ink based on image data. For each print head H, an ejection port array (nozzle array) that is a predetermined arrangement of a plurality of ejection ports is formed on the ejection port face, opposite the printing medium SH. The ejection port array is extended in a direction across the conveying direction A1 (in this embodiment, a direction perpendicular to the conveying direction A1). Ejection energy generation elements are arranged along liquid paths that communicate with the individual ejection ports of the ejection port array, and when the ejection energy generation elements are selectively driven based on image data to eject ink droplets, a desired image is formed. The ejection energy generation elements can be, for example, electro-thermal conversion elements (heaters) or electro-mechanical conversion elements (piezoelectric elements).

Further, the print head H in FIG. 3 forms a so-called line head where the ejection ports are arranged in a range equivalent to, or beyond the maximum width of the printing medium to be employed (the "width of the printing medium" is the length of the printing medium in a direction that intersects the conveying direction A1). The image forming apparatus 100 of this embodiment is an ink jet printing apparatus of full-line printing type that employs the line head and forms an image for one line on a printing medium that is sequentially conveyed. It should be noted, however, that the present invention can also be applied for a so-called serial ink jet printing apparatus that performs printing by moving a print head in the direction that intersects the direction in which a printing medium is to be conveyed.

The print head H is to be moved upward and downward (a direction from the conveying path R to be described later toward the print head H, and a direction from the print head H to the conveying path R) by a head moving mechanism that is driven by the drive force of a head elevating motor 1210. For forming an image on the printing medium H, the head elevating motor 1210 is driven to move the print head H down from an elevated position P1 in FIG. 3 to an image formation position P3 (see FIG. 5) that is appropriate for image forming for the printing medium SH and that is closer to the conveying path R than to the P1, and the print head H thereafter ejects ink droplets from the ejection ports to form an image. When image forming has been performed, the print head H is elevated to the elevated position P1. Thereafter, the recovery tub 112 is horizontally moved to a position below the print head H, and the print head H is moved down to the recovery tub 112. As a result, the ejection port face of the print head H closely contacts the recovery tub 112 and is blocked from the external air, and the ejection ports and the ejection port face are protected.

The pump unit 113 that performs a suction operation is connected to the recovery tub 112. Occasionally, tiny dust, for example, is attached to the ejection ports of the print head H, and causes printing defects. In this case, the pump unit 113 performs suction by bringing the ejection port face of the print head H in close contact with the recovery tub 112, and as a result, tiny dust attached to the ejection ports can be removed. When the pump unit 113 performs the suction operation for the print head H in this manner, not only tiny dust attached to the ejection ports, but also ink remaining in the print head H is drawn by suction. The ink thus drawn by suction is transmitted through the recovery tub 112 to the maintenance cartridge 202, and is absorbed by and stored in an absorber 203 of the maintenance cartridge 202. A conductivity sensor for detecting the amount of absorbed waste ink is provided for the maintenance cartridge 202.

The conveying unit 103 includes the feeding part 118, the conveying part 119 and the discharge part 120. The conveying unit 103 also includes the conveying motor 115, the roll drive motor 116, the cutter unit 114, and a printing medium detection unit that detects the printing medium SH. The printing medium detection unit includes an upstream medium detector, which is located at a position opposite a light transmission window 702U (see FIG. 7) arranged upstream of the printing medium conveying path R, and a downstream medium detector, located at a position opposite a light transmission window 702D (see FIG. 7) arranged downstream of the conveying path R. The upstream medium detector includes a thru-beam sensor 1221 and a reflective sensor 1222 (see FIG. 12) located at positions opposite the light transmission window 702U. The downstream medium detector includes a reflective sensor 1224 located at the position opposite the light transmission window 702D. The thru-beam sensor 1221 includes a projector and a photodetector that are arranged opposite to each other with the light transmission window 702U in between, and light emitted by the projector is transmitted through the backing paper portion of the printing medium SH, and is received by the photodetector, but the light is blocked on labels on the backing paper, and is not received by the photodetector. Therefore, in a case wherein a signal transmitted by the photodetector is changed at a predetermined interval, it can be ascertained that the printing medium SH is being moved along the conveying path R. Further, the reflective sensor 1222 includes a projector and a photodetector provided opposite the light transmission window 702U, and light emitted by the projector is reflected at the backing paper portion of the printing medium SH, and the reflected light is received by the photodetector. Therefore, based on the output of the photodetector of the reflective sensor 1222, whether the printing medium SH is located above the light transmission window 702U or not can be determined.

Figure 8:
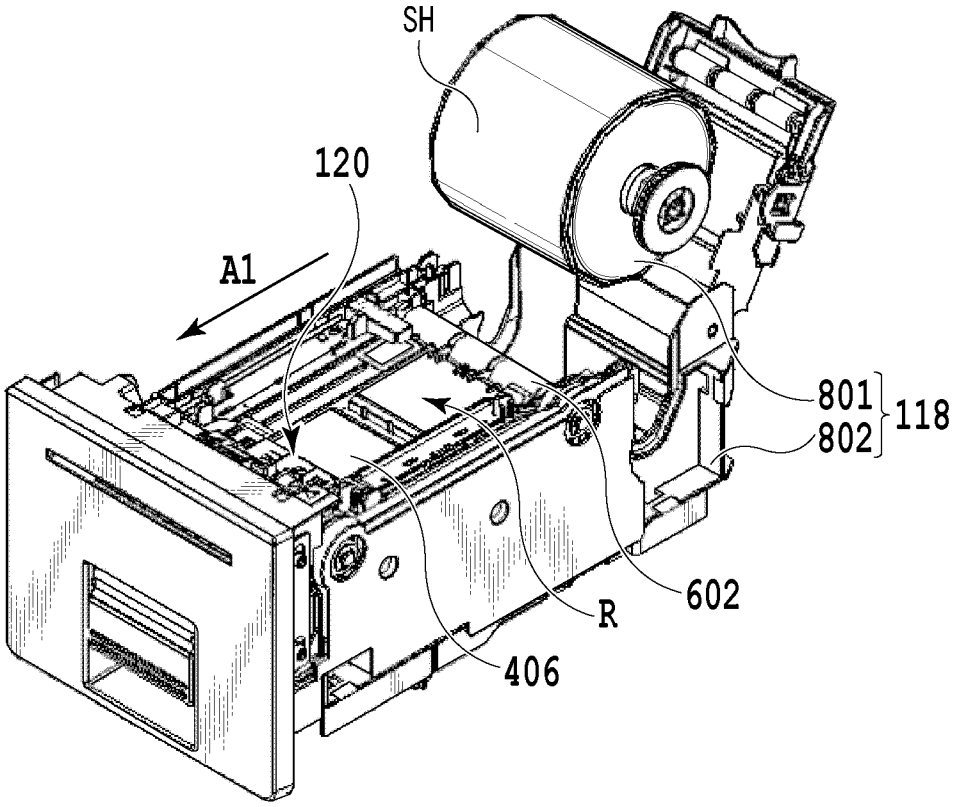
FIG. 8 is a perspective view of the state wherein a spool is removed according to the first embodiment.

As shown in FIG. 8, the feeding part 118 includes a spool 801 that serves as a medium supply source, in which the printing medium SH in a continuous sheet form is rolled, and a spool holder 802 that rotatably supports the spool 801.

Figure 6:
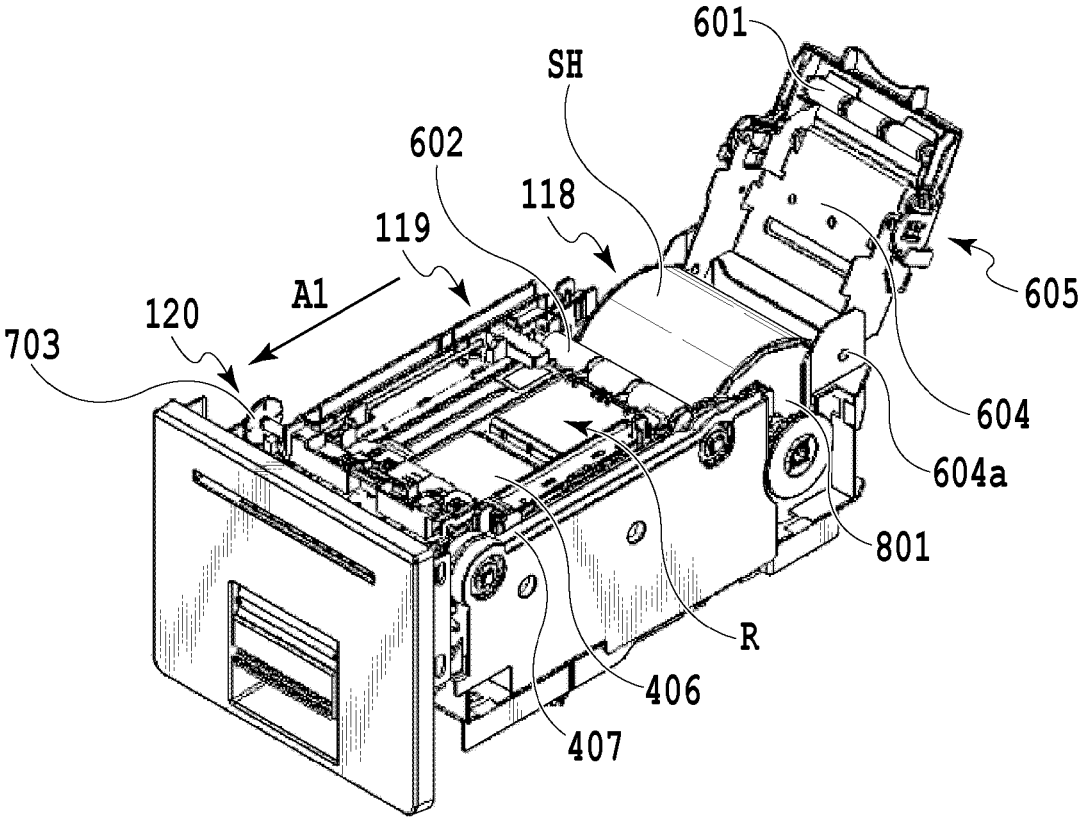
FIG. 6 is a perspective view of the state wherein a pinch rollers are released form a printing medium according to the first embodiment.

Furthermore, as shown in FIG. 6, the conveying part 119 includes conveying rollers 602, pinch rollers 601, and a platen 406, which is provided on the upper face of a conveying frame 407 that is a support structure of the conveying unit 103.

Figure 10:
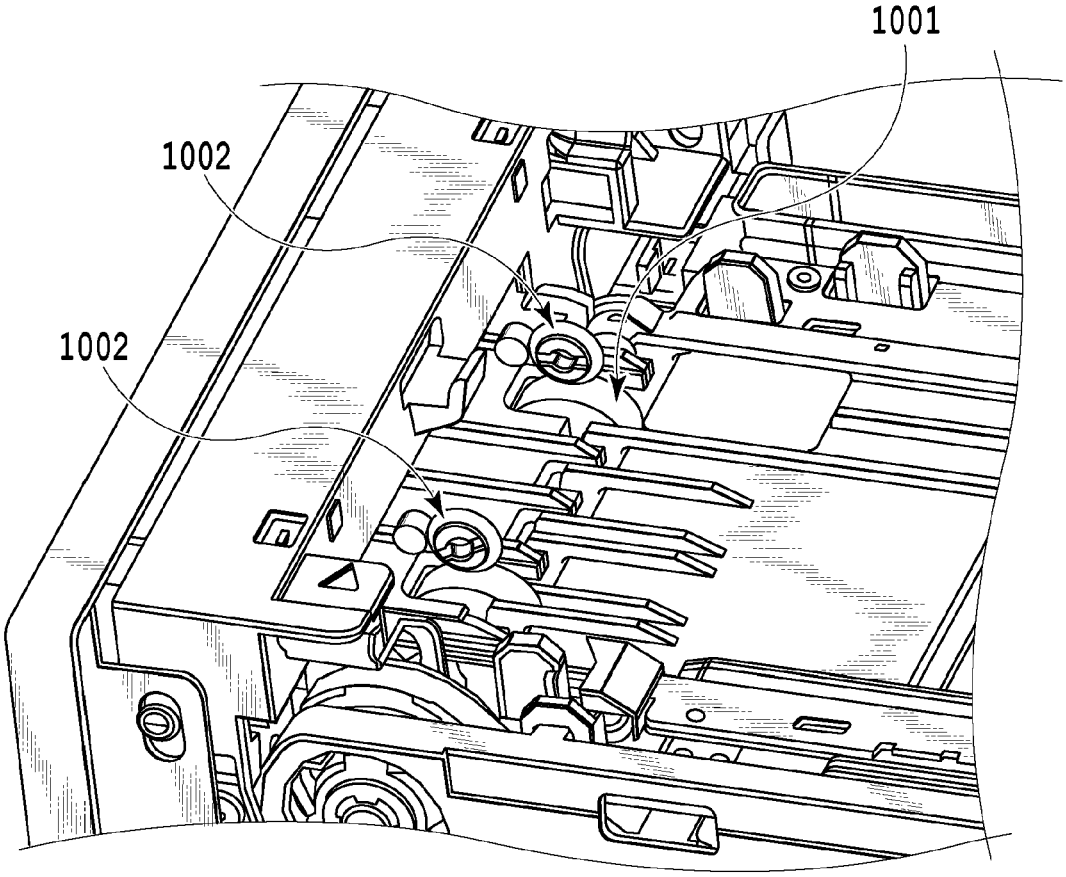
FIG. 10 is a perspective view of the positional relationship between discharge rollers and spurs when the spur holder unit is installed according to the first embodiment.

The discharge part 120 includes discharge rollers 1001 shown in FIG. 10 and a spur holder unit 701 (see FIG. 7) that holds spurs 1002 that can be pressed against the discharge rollers 1001. The spur holder unit 701 has a structure wherein a pair of spurs 1002 and the rotary plate of an encoder are securely fitted to a rotary shaft that is rotatably supported to a shaft support portion. The spur holder unit 701 is detachably attached relative to the conveying frame 407. The conveying path R is formed for the conveying unit 103, and is extended from the conveying rollers 602 of the conveying part 119 across the platen 406 to the discharge rollers 1001 of the discharge part 120.

The printing medium SH is sandwiched between the pinch rollers 601 of the pinch roller unit 605 and the conveying rollers 602, and is conveyed, in accordance with rotations of the conveying rollers 601, from the feeding part 118 along the conveying path R of the conveying unit 103. That is, the conveying unit 103 includes two conveying mechanisms: the upstream conveying mechanism that has the conveying rollers 602 to perform feeding and conveying of the printing medium SH, and the downstream conveying mechanism that has the discharge rollers 1002 to perform discharging of the printing medium SH. The conveying rollers 602 and the discharge rollers 1001 interact with each other to rotate and convey the printing medium SH. When the printing medium SH is conveyed by the conveying rollers 602 and the pinch rollers 601, the leading edge of the printing medium SH is detected by the upstream medium detector, and controls the start to drive the print head H based on the detection position as a reference, and then, the print head H forms an image at the appropriate location of the printing medium H. When an image has been formed on the printing medium SH, the printing medium SH is held by the discharge rollers 1001 and the spurs 1002 of the spur holder unit 701, and is discharged outside of the conveying unit 103 in accordance with the rotations of the discharge rollers 1001.

Figure 9:
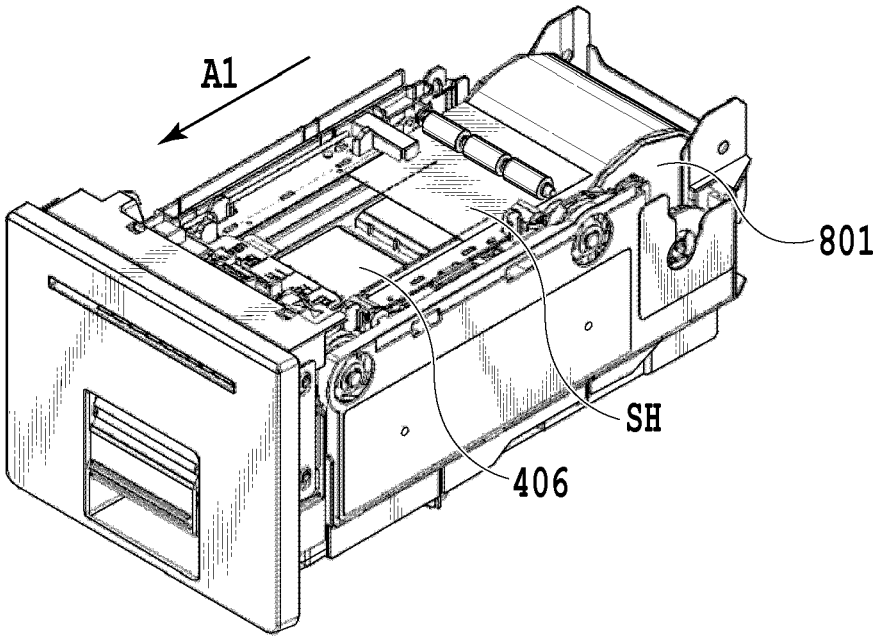
FIG. 9 is a perspective view of the state wherein a printing medium is being conveyed according to the first embodiment.

The state shown in FIG. 9 is the state wherein the printing medium SH is conveyed in the conveying direction A1 along the conveying path R by being sandwiched between the conveying rollers 602 and the pinch rollers 601 of the pinch roller unit 605 in the above described manner. In a case wherein a paper jam occurs at the feeding part 118 of the conveying unit 103 during the conveying operation, the user pulls the conveying unit 103 out of the main body 101 in the conveying direction A1, as described above (see FIG. 2). Then, as shown in FIG. 6, a pinch roller base 604 of the pinch roller unit 605 is pivoted upward at a rotation center 604*a* to a retraction position. When the pinch roller base 604 is pivoted, the pinch rollers 601 are moved to a higher position, and are separated from the conveying rollers 602. As a result, since the printing medium SH sandwiched between the roller 602 and the pinch roller 601 is released, the printing medium SH jammed inside the feeding part 118, or the spool 801, can be removed, and the paper jam can be cleared. Likewise, in a case wherein a paper jam has occurred in the conveying part 119 of the conveying unit 103, the conveying unit 103 is also pulled from the main body 101 in the conveying direction A1 (indicated by the arrow), and the printing medium SH is released, as needed, by moving the pinch rollers 601 upward to clear the paper jam.

FIG. 10 is a perspective view of the positional relationship between the discharge rollers 1001 and the spurs 1002 of the discharge part 120 when the spur holder unit 701 is mounted to the conveying unit 103. During the conveying operation, the discharge rollers 1001 are rotated by interlocking with the conveying rollers 602, while the rotation of the pinch rollers 601 is performed, following the rotation of the discharge rollers 1001. In a case wherein the conveying of the printing medium SH is correctly performed, the printing medium SH conveyed along the conveying path R by being sandwiched between the conveying rollers 602 and the pinch rollers 601 is discharged outside the conveying unit 103 by the discharge rollers 1001 and the spurs 1002 that are rotated by interlocking with the conveying rollers 602.

Furthermore, when a paper jam has occurred in the discharge part 120, a pulse signal is generated by an encoder 1225, which includes a rotatory plate that is rotated together with the spurs 1002 fitted to the rotary shaft of the spur holder unit 701, and a projector/photodetector that detects the slit formed in the rotary plate. This pulse signal is transmitted to a CPU 1202, which then employs the count value of the pulse signals and the output of the reflective sensor 1224 to determine whether the spurs 1002 are appropriately rotated, i.e., whether the printing medium SH is properly conveyed by the discharge part 120 (i.e., whether a paper jam has occurred).

Figure 7:
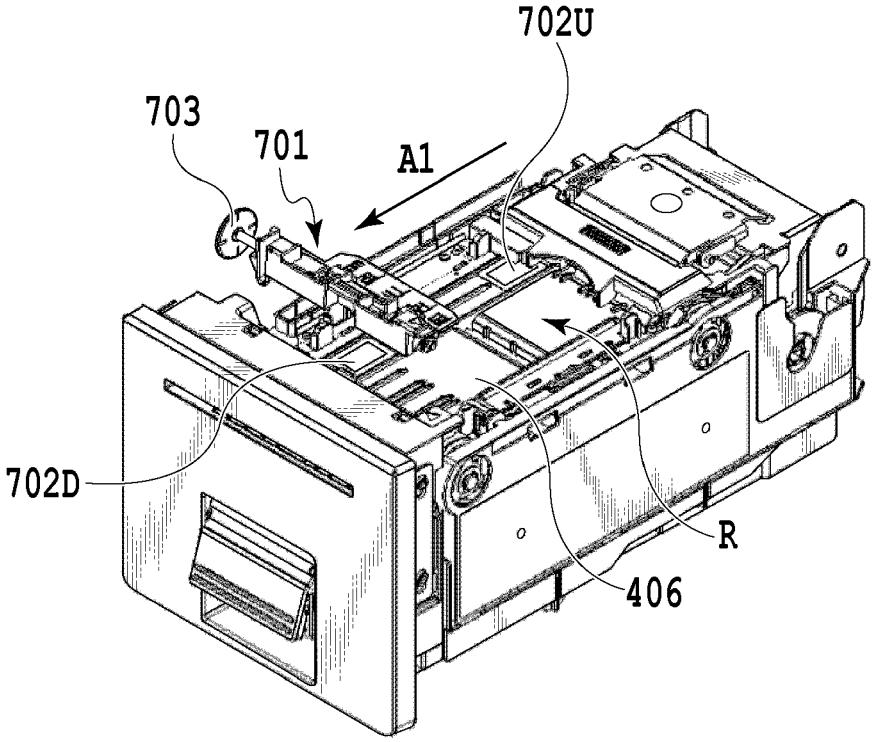
FIG. 7 is a perspective view of the state wherein a spur holder unit is removed according to the first embodiment.

In a case wherein it is determined that a paper jam has occurred in the discharge part 120 of the conveying unit 103, the conveying unit 103 is pulled from the main body 101 in the conveying direction A1, as shown in FIG. 2, and the spur holder unit 701 is removed from the conveying unit 103, as shown in FIG. 7. As a result, the portion around the conveying path R is exposed, and a paper jam clearing process can be easily performed.

FIG. 8 is a perspective view of the state wherein the replacement or replenishment of the printing medium SH is performed at the feeding part 118 of the conveying unit 103. When exhaustion of the printing medium SH in the feeding part 118 occurs as the result of printing, or replacement of the printing medium SH is required, first, the conveying unit 103 is pulled out of the main body 101 in the conveying direction A1 (see FIG. 2). Thereafter, as shown in FIG. 6, the pinch roller base 604 of the pinch roller unit 605 is pivoted upward at the rotation center 604*a*. As a result, the spool 801 to which a roll of the printing medium SH is to be fitted can be removed from the spool holder 802 of the main body 101, and the replacement or replenishment of the printing medium SH is enabled.

Figure 11:
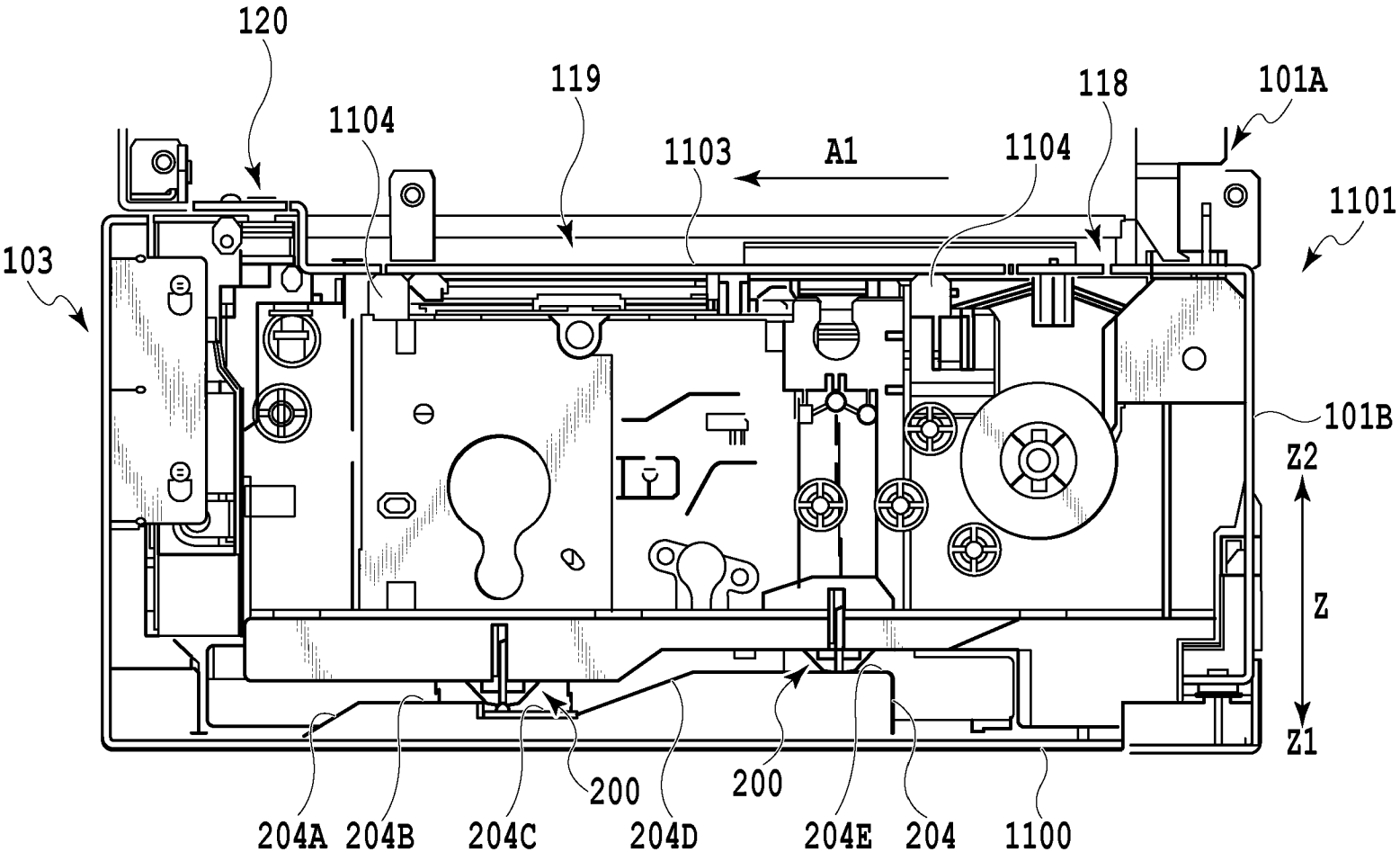
FIG. 11 is aside view in longitudinal cross section of the image forming apparatus according to the first embodiment wherein the conveying unit is mounted to the image forming apparatus main body.

FIG. 11 is a cross-sectional view of the state wherein the conveying unit 103 is arranged inside the second housing 101B of the main body 101. A plurality of protruded portions 1104 (conveying unit side protrusions) are formed on the upper side of the conveying unit 103 along the conveying path R, and are employed to perform vertical positioning for the conveying unit 103 with respect to the print head H when the conveying unit 103 is inserted into the main body 101. Further, a plurality of abutment mechanisms 200 are formed on the lower side of the conveying unit 103, and are employed to force the protruded portions 1104 to abut upon the lower face of a reference plate 1103 of the main body 101 when the conveying unit 103 is mounted to the main body 101.

Figure 12:
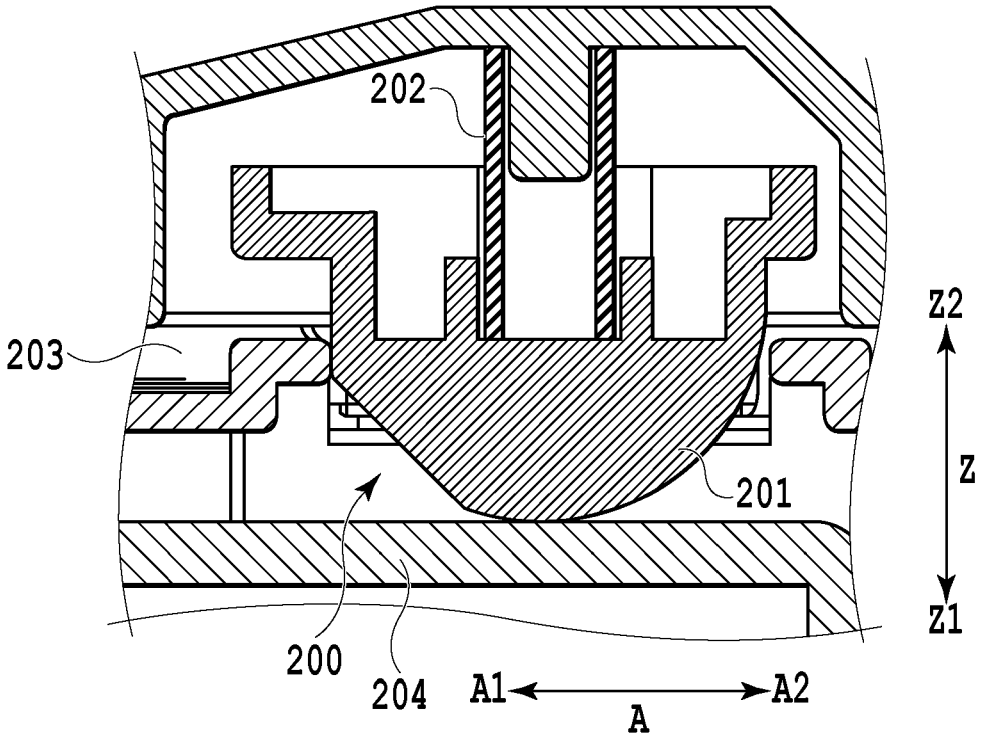
FIG. 12 is an enlarged side view in longitudinal cross section of the structure of an abutment mechanism shown in FIG. 11.

FIG. 12 is an enlarged side view in cross section of the structure of the abutment mechanism 200 in FIG. 11 for the first embodiment. The abutment mechanism 200 includes a sliding member (a movable contact member) 201 made of, for example, a resin, an elastic member 202 that exerts an elastic force to push the sliding member 201 in a direction Z1, and a guide member 203 that guides the sliding member 201 in a direction Z (Z1 or Z2). The guide member 203 is provided for the conveying frame 407 of the conveying unit 103. In this embodiment, the direction Z corresponds to a direction that intersects the printing medium passage face of the conveying path R (in FIG. 11, the vertical direction that intersects the printing medium passage face), and the direction Z1 represents the downward direction (a direction from the print head H to the conveying path R), and the direction Z2 represents the upward direction (a direction from the conveying path R to the print head H).

Figure 13A:
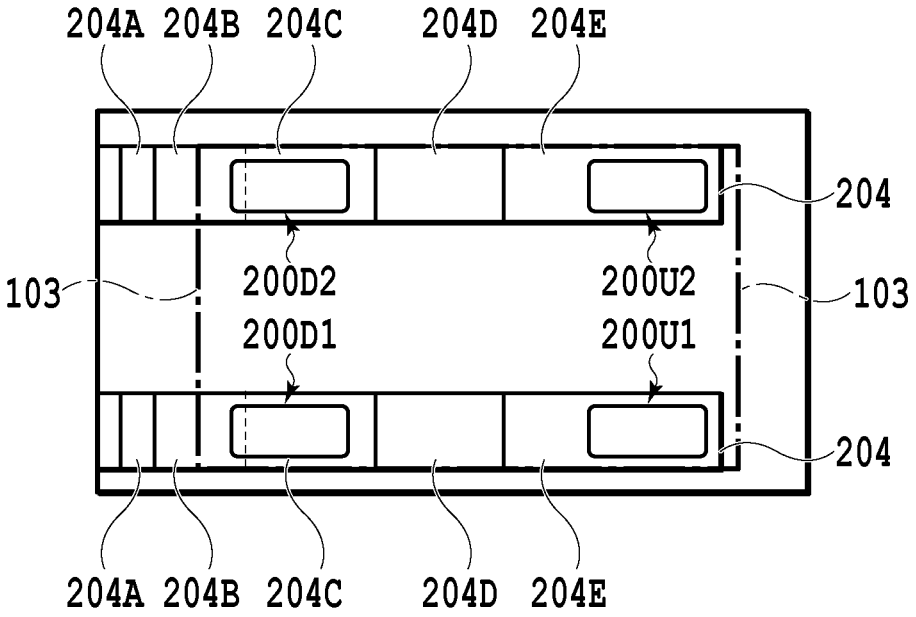
FIGS. 13A and 13B are conceptual schematic diagrams showing the arrangement and the structure for the abutment mechanisms in FIG. 11.
Figure 13B:
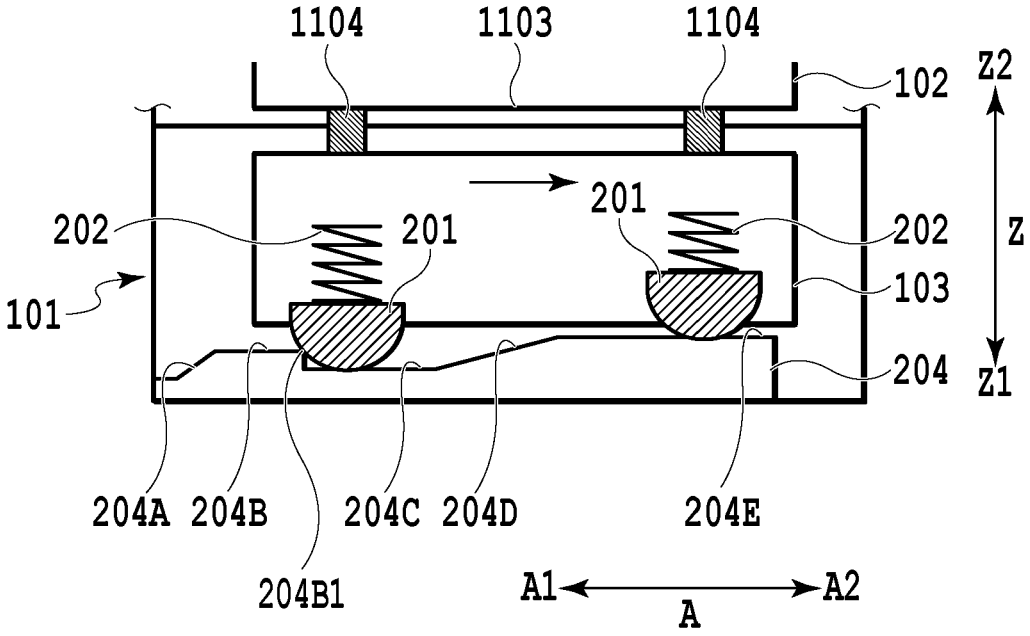

FIGS. 13A and 13B are conceptual schematic diagrams illustrating the arrangement and the structure for the abutment mechanisms 200 in this embodiment. FIG. 13A is a schematic top view of the image forming apparatus 100 (viewed in the direction Z1), and FIG. 13B is a schematic diagram showing the image forming apparatus 100 viewed from the right side R. In this embodiment, the abutment mechanisms 200 are arranged at a plurality of upstream and downstream locations in the conveying direction (direction A1), and referring to FIG. 13A, the total four abutment mechanisms 200, two each for the upstream and downstream, are provided. In FIG. 13A, abutment mechanisms 200U1 and 200U2 are those located upstream in the conveying direction, while abutment mechanisms 200D1 and 200D2 are those located downstream. In this embodiment, the conveying unit 103 is to be inserted into the second housing part 101B in the direction (direction A2) opposite, in plan view, to the direction (direction A1) in which the printing medium SH is to be conveyed. Therefore, the upstream position or the upstream side in the conveying direction corresponds to the rear position or rear side in the direction in which the conveying unit 103 is to be inserted (hereinafter, simply referred to as an insertion direction), and the downstream position or the downstream side in the conveying direction corresponds to the front position or the front side in the insertion direction.

Therefore, the abutment mechanisms 200U1 and 20U2 can be also referred to as abutment mechanisms located at the rear in the insertion direction, while the abutment mechanisms 200D1 and 200D2 can be referred to as abutment mechanisms located in front in the insertion direction.

Further, the two abutment mechanisms 200U1 and 200D1 are arranged on the same linear line that is parallel to the insertion direction (direction A2). Similarly, the other two abutment mechanism 200U2 and 200D2 are arranged on the same linear line that is parallel to the insertion direction (conveying direction). The distance between the abutment mechanisms 200U1 and 200U2 is equal to the distance between the abutment mechanisms 200D1 and 200D2. Furthermore, the upstream abutment mechanisms 200U1 and 200U2 are arranged by being shifted from the downstream abutment mechanisms 200D1 and 200D2 in the direction Z2 (upper direction).

The lower face of the reference plate 1103 described above serves as a reference position in the direction that intersects the printing medium passage face of the conveying path R (in FIG. 11, the vertical direction (direction Z) that intersects the printing medium passage face). That is, the Z-directional position of the ejection port face of the print head H that is held in the first housing 101A and the Z-directional position of the conveying unit 103 for the printing operation are determined by employing, as a reference, the lower face of the reference plate 1103 that serves as a reference member.

Two rails (support members) 204 projected in the direction Z2 (upper direction) and extended in the insertion direction (direction A2) are arranged at the bottom of the second housing 101B where the conveying unit 103 can be accepted. As shown in FIG. 11, the two rails 204 each includes a slope face 204A, a raised portion 204B, a recessed portion 204C, a slop face 204D and a raised portion 204E that are sequentially formed in the insertion direction (direction A2) that is opposite the printing medium conveying direction (direction A1). In a case wherein the conveying unit 103 is to be mounted to the second housing 101B, the conveying unit 103 is inserted in a direction B by guiding the sliding member 201 along the two rails 204. Then, the sliding members 201 are moved in the direction Z2 along the slope faces 204A and 204B of the rails 204, and finally, the upstream abutment mechanisms 200U1 and U2 reach the raised portions 204E of the rails 204, while the downstream abutment mechanisms 200D1 and 200D2 are moved from the raised portions 204B and reach the recessed portions 204C on the downstream side. At this time, since the elastic members 202 of the individual abutment mechanisms 200 that are compressed push the conveying unit 103 in the direction Z2 (upper direction), the raised portions 1104 of the conveying unit 103 are brought in contact with the lower face of the reference plate 1103. As a result, the distance between the surface of the platen 406, serving as the medium passage face of the conveying unit 103, and the reference face is obtained as a distance required for the printing operation, and mounting of the conveying unit 103 to the main body 101 has been completed. In the state wherein the conveying unit 103 has been mounted, when the print head H is lowered to a printing ready position (image forming position), the distance between the ejection port face of the print head H and the platen 406 of the conveying unit 103 is set to the distance at which appropriate printing for the printing medium can be performed.

Furthermore, when the conveying unit 103 has been mounted to the main body 101, the downstream abutment mechanisms 200D1 and 200D2 are in the state wherein the outer middle portions of the sliding members 201 are caught in contact with upstream ends 204B1 of the raised portions (projected portions) 204B. Therefore, so long as a force of a predetermined level or higher is not applied to the conveying unit 103 in the conveying direction (direction A1), movement of the conveying unit 103 in the conveying direction can be prevented. For example, even when the main body 101 is tilted after the conveying unit 103 has been mounted, and a gravitational force is applied to the conveying unit 103 in a direction to slip off from the main body 101, the conveying unit 103 can be held at the mounting position by contacting the raised portions 204B. In other words, sufficiently strong engagement force against the weight of the conveying part 103 is to be exerted between the conveying unit 103 and the upstream ends 204B1 of the raised portions 204B.

Figure 5:
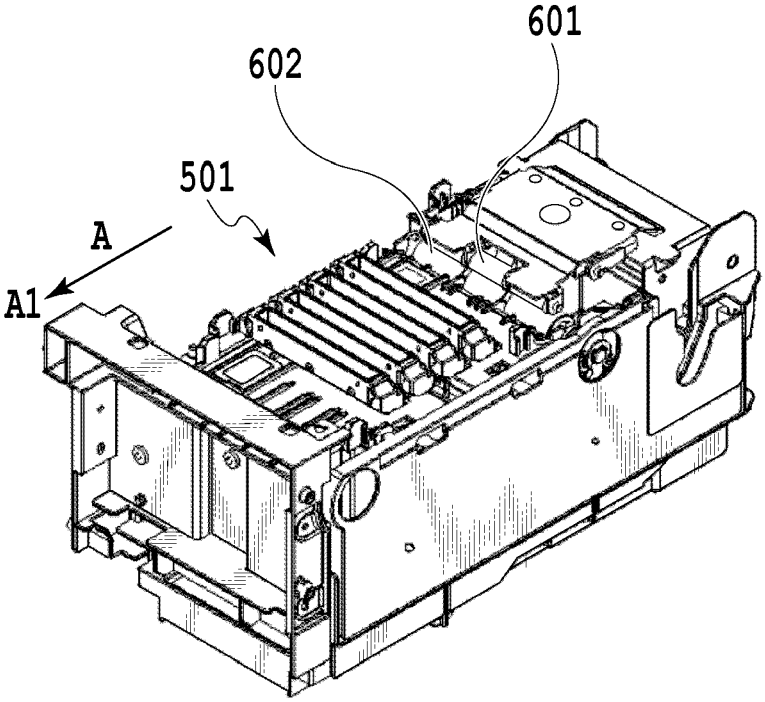
FIG. 5 is a perspective view of the positional relationship between a print head and the conveying unit during the printing operation performed for the first embodiment.
Figure 14:
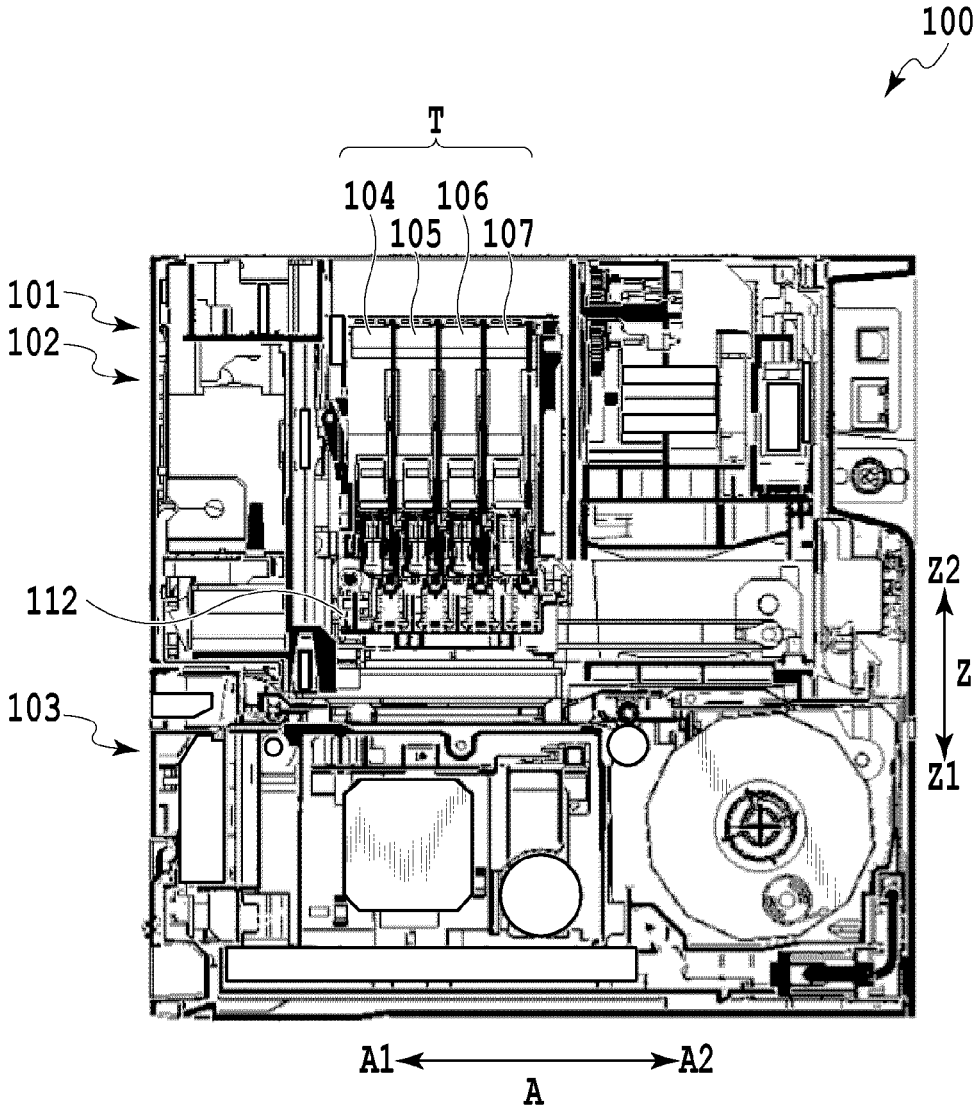
FIG. 14 is aside view in longitudinal cross section of the state wherein the print heads are closely covered with a recovery tub at a restoring position.

In the standby state wherein the printing operation is not performed, the print head H closely contacts the recovery tub 112 at a standby position higher than the printing ready position in FIG. 5, and the ejection port face is protected at this position (see FIG. 14). Therefore, in a case wherein the print head H is to be moved from the standby position to the printing ready position, the print head H is first moved upward from the standby position in FIG. 14, and thereafter, the recovery tub 112 is moved from the cap position immediately below the ejection port face in the lateral direction (direction opposite the conveying direction A1 in FIG. 3) to the retraction position, at which the recovery tub 112 does not bother the movement of the print head H to the printing ready position. In this state, the print head H is moved to the printing ready position.

Further, in the state wherein the print head H is at the printing ready position, the platen 406 of the conveying unit 103 is near the ejection port face of the print head H. Therefore, when the conveying unit 103 is to be removed in this state, the upper portion of the conveying unit 103 might interfere with the ejection port face of the print head H, and damage the ejection port face. In this embodiment, when the print head H is at the printing ready position, the print head H is set to the location that interferes with the area where the conveying unit 103 passes at the time of detachment relative to the second housing 101B. Therefore, in a case wherein removal of the conveying unit 103 is performed for this embodiment, the print head H is moved, prior to the removal process, to the retraction position, such as the elevated position in FIG. 3 or the standby position in FIG. 14, at which insertion or drawing of the conveying unit 103 relative to the second housing 103 is not bothered. This control operation is performed by a control system that will be described below. In this embodiment, the recovery tub 112 is provided not to interrupt the detachment of the conveying unit 103 relative to the second housing 101B, regardless of whether the recovery tub 112 is located at the cap position, the retraction position, or a position between the cap position and the retraction position. That is, the recovery tub 112 is arranged at a location at which the recovery tub 112 does not interfere with the area where the conveying unit 103 passes (the recovery tub 112 is located in the direction Z2 for the conveying unit 103).

Figure 15:
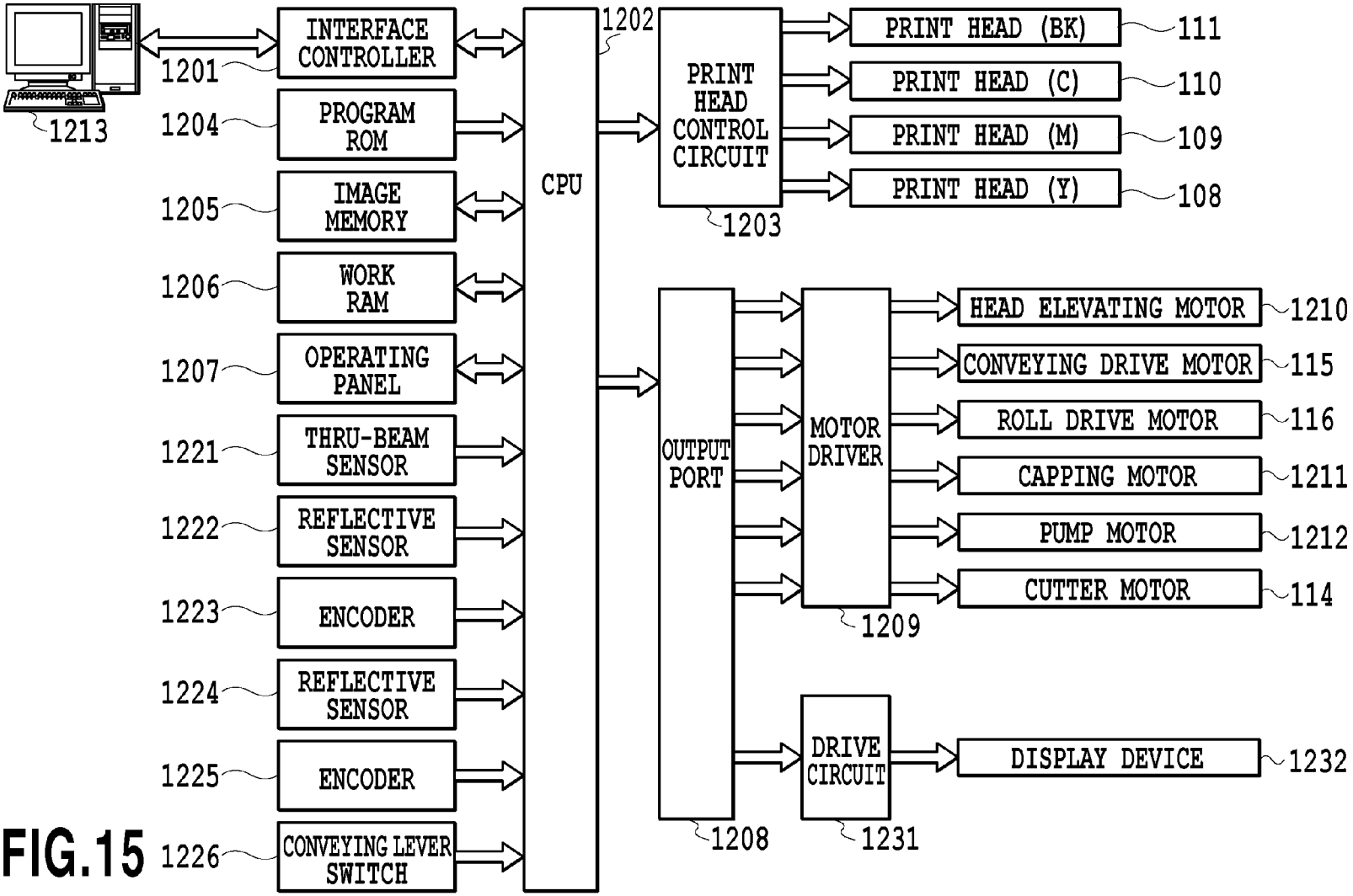
FIG. 15 is a schematic block diagram illustrating the arrangement of a control system for the first embodiment.

FIG. 15 is a schematic block diagram illustrating the arrangement of a control system provided for the image forming apparatus 100 of this embodiment. In FIG. 15, print data and commands are transmitted by a host PC 1213 via an interface controller 1201, and are received by the CPU 1202. The CPU 1202 is an operation processing part that controls the operations of the entire apparatus, such as reception of print data for the image forming apparatus 100 and control for the feeding part 118, the conveying part 1129 and the discharge part 120. The CPU 1202 analyzes a received command, and draws, in an image memory 1205, a bit map of image data for the individual color components of the print data. For performing the pre-processing for printing, a capping motor 1211 that operates the recovery tub 112 and the head elevating motor 1210 that operates the print head H are driven via an output port 1208 and a motor driver 1209, and these motors separate the print heads 108 to 111 from the recovery tub 112, and move the print heads 108 to 111 to the printing ready position.

Sequentially, the roll drive motor 116 that winds the printing medium SH and the conveying motor 115 that conveys the printing medium SH are driven through the output port 1208 and the motor driver 1209, and these motors convey the printing medium SH to the printing ready position. The upstream printing medium detector detects the leading edge of the printing medium SH to determine a timing (printing timing) for start of ejection of ink to the printing medium SH that is conveyed at a predetermined speed. Thereafter, in synchronization with conveying of the printing medium SH, the CPU 1202 reads, in order, print data of corresponding colors from the image memory 1205, and transmits the print data to the print heads 111, 110, 109 and 108 via a print head control circuit 1203.

The operation of the CPU 1202 is performed based on process programs stored in a program ROM 1204. The process programs and tables corresponding to various control operations are stored in the program ROM 1204. Further, a work RAM 1206 is employed as a work memory. In the cleaning operation or the recovery operation of the print heads 111K, 110C, 109M and 108Y, the CPU 1202 drives a pump motor 1212 via the output port 1208 and the motor driver 1209 to exercise control, such as application of pressure to ink and performance of suction.

The CPU 1202 also receives detection signals from the thru-beam sensor 1221, the reflective sensor 1222 and the encoder 1223, all of which are included in the upstream medium detector, and receives detection signals from the reflective sensor 1224 and the encoder 1225, both of which are included in the downstream medium detector. Furthermore, a conveying lever switch 1226 is connected to the CPU 1202, and outputs an ON/OFF signal in accordance with the operating state of the conveying lever 304 that is provided on the front face of the conveying unit 103. Based on the signals received from the sensors and the switch, CPU 1202 controls the individual motors described above, the print heads H and a display device 1232. The display device 1232 is driven by the CPU 1202 through the output port 1208 and a drive circuit 1231, and displays various statuses, such as the occurrence of a paper jam in the main body 101 and the exhaustion of sheets in the feeding part 118. The upstream medium detector, the downstream medium detector and the CPU 1202 constitute conveyance defect detection unit that detects a paper jam and the absence of sheets, described above.

The control operation performed by the control system will now be described based on flowcharts in FIGS. 16 to 18. The processing in the flowcharts in FIGS. 16 to 18 is performed by the CPU 1202.

Figure 16:
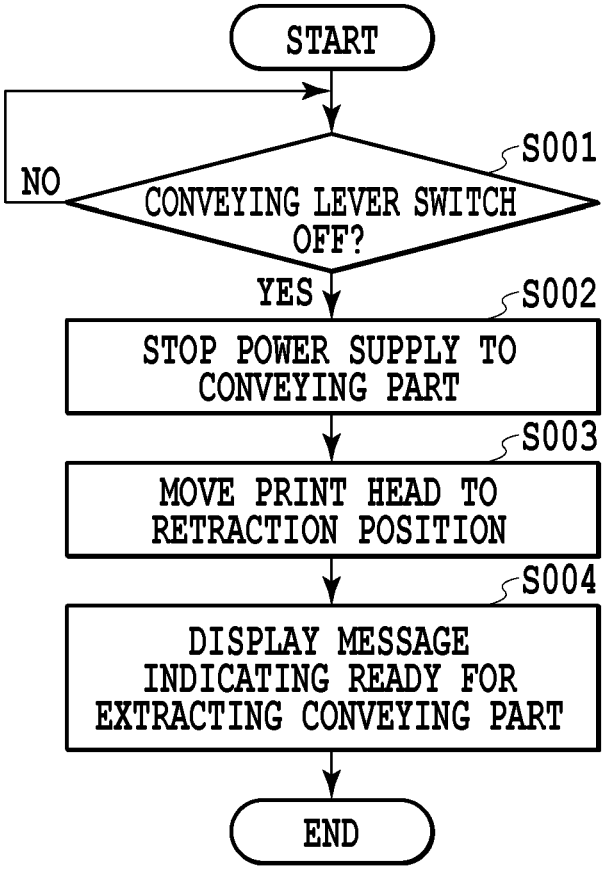
FIG. 16 is a flowchart showing the processing performed for the first embodiment, beginning with turning up an extraction lever until removing the conveying unit.

FIG. 16 is a flowchart showing the control operation performed when the conveying lever 304 is pulled up. When the conveying lever 304 of the conveying unit 103 is pulled up, the conveying lever switch 1226 that is set ON or OFF by interlocking with the conveying lever 304 is set to the ON state (S001), and the CPU 1202 cuts off the supply of power to the conveying unit 103 (S002). Through this control operation, the occurrence of hot swapping can be prevented when the conveying unit 103 is extracted. Following the operation at S002, the CPU 1202 moves the print head H to the retraction position (either the elevated position or the standby position) (S003), and allows the conveying unit 103 to be extracted while preventing the conveying unit 103 from contacting the print head H. At this time, the CPU 1202 displays, on the display device 1232, a message that removing of the conveying unit 103 is ready (S004). In a case wherein the print head H is already located at the retraction position after the process at S002 has been performed, program control skips step S003 and performs the process at step S004. Further, at step S003, the print head H may be moved to the standby position, and the ejection ports of the print head H may be covered with the recovery tub 112, or the print head H may be moved to the elevated position.

Figure 17:
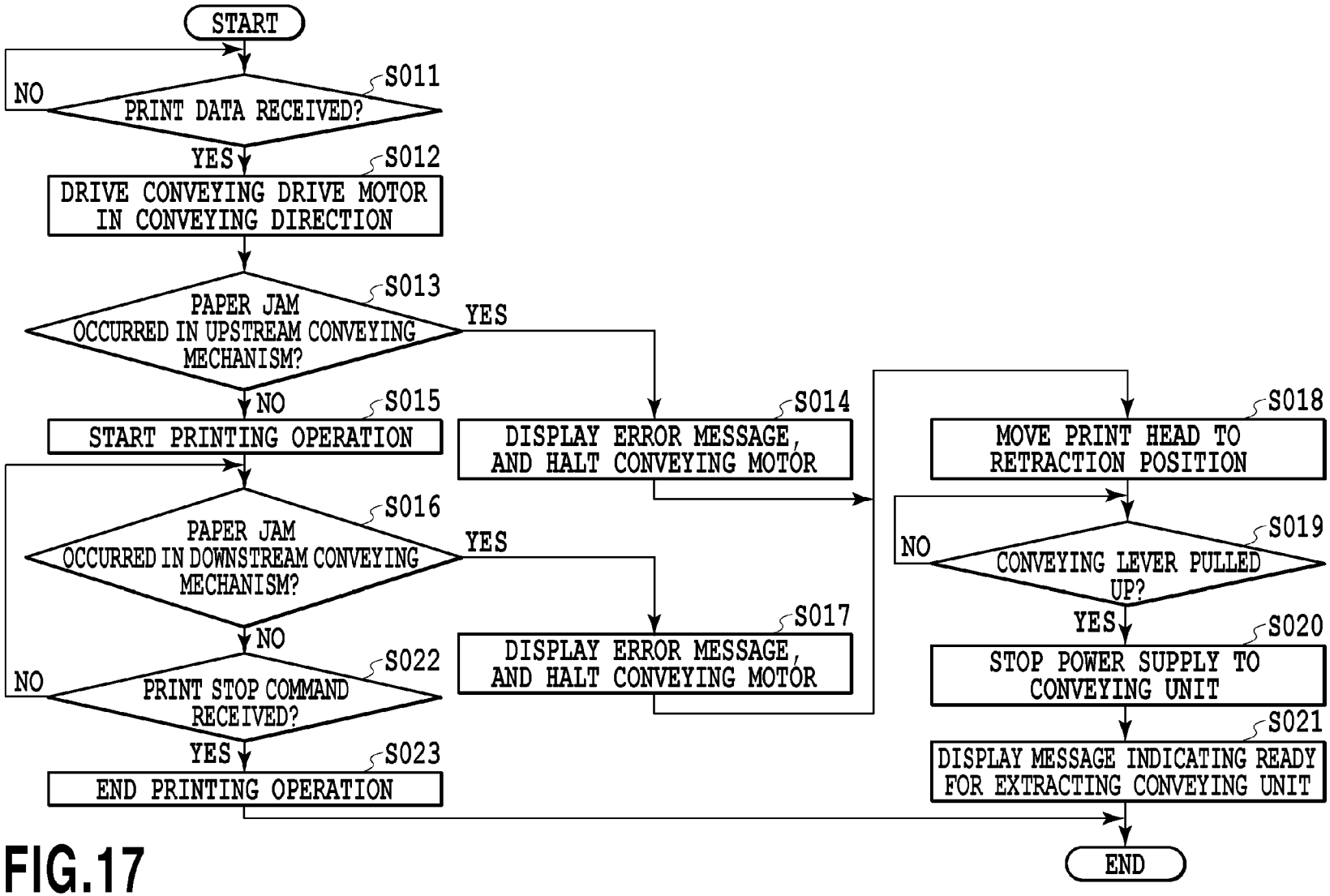
FIG. 17 is a flowchart showing the processing performed for the first embodiment when a jam of the printing medium occurs after print data has been received.
Figure 18:
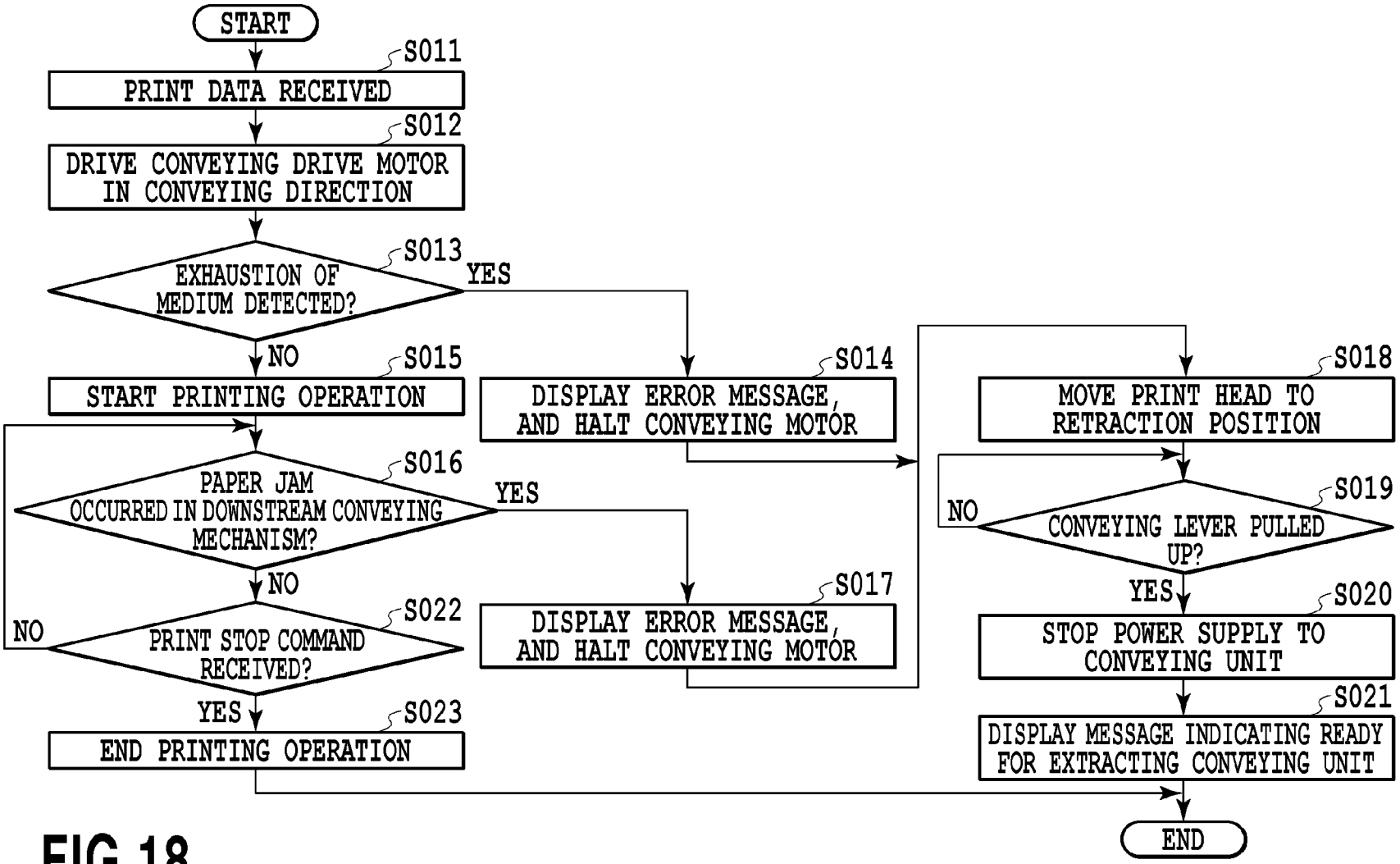
FIG. 18 is a flowchart showing the processing performed for the first embodiment when a medium exhaustion state occurs when print data has been received.

FIG. 17 is a flowchart showing the control operation performed when a jam of the printing medium SH is detected based on the outputs of the upstream medium detectors (1221 and 1222) and the encoder 1223 and the output of the reflective sensor 1224 that serves as the downstream medium detector. When the print data is transmitted by the host PC 1213 through the interface controller 1202, and is received by the CPU 1202 (S011), the CPU 1202 drives the conveying drive motor 115 (S012) to begin the feeding operation and the conveying operation for the printing medium SH. Thereafter, based on the signals output by the thru-beam sensor 1221 and the reflective sensor 1222 and the pulse signal output by the encoder 1223, the CPU 1202 determines whether the printing medium SH has been property conveyed and has reached the upstream light transmission window 702U.

Specifically, in a case wherein the pulse signal is received from the encoder 1223 and the printing medium SH is detected by the reflective sensor 1222, but the signal transmitted by the thru-beam sensor 1221 does not continuously change, the CPU 1202 determines that a paper jam has occurred in the upstream conveying mechanism (S013). At this time, in a case wherein the leading edge of the printing medium SH is not detected by the reflective sensor 1221, the CPU 1202 determines that a paper jam has occurred in the upstream conveying mechanism. Furthermore, in a case wherein a pulse signal is not output by the encoder 1223 after the conveying operation has been initiated, or in a case wherein the number of pulses that corresponds to the time elapsed from the start of the conveying operation is not obtained, the CPU 1202 also determines that a paper jam has occurred.

When it is ascertained at step S013 that a paper jam has occurred, at S014 driving of the conveying drive motor 115 is halted, and an error message is displayed on the display device 1232. Thereafter, the CPU 1202 moves the print head H to the retraction position, such as the elevated position in FIG. 3, or the standby position in FIG. 14 (S018). Following the process at S018, the CPU 1202 examines the signal of the conveying lever switch 1226 to determine whether the conveying lever 304 has been pulled up (S019). When the conveying lever 304 has been pulled up, supply of electric power to the conveying unit 103 is halted (S020). As a result, the conveying unit 103 is ready for being extracted, and a message for this effect is displayed on the display device 1232 (S021). When it is ascertained at step S016 that a paper jam does not occur, at S022 a check is performed to determine whether a printing halt instruction is received. When a printing halt instruction is received, the printing operation is stopped, and thereafter, the print head H is moved either to the standby position, at which the ejection ports of the print head H are covered with the recovery tub 112, or to the elevated position (S023), and the processing is terminated.

In a case wherein it is ascertained at decision step S013 that a paper jam does not occur in the upstream conveying mechanism, the CPU 1202 drives the conveying drive motor 115, and also drives the individual print heads H based on the print data to begin the printing operation (S015). Further, based on the pulse signals received from the reflective sensor 1224 and the encoder 1225 that constitute the downstream medium detector, the CPU 1202 determines whether a paper jam has occurred in the downstream conveying mechanism (S016). Specifically, when the printing operation is begun, CPU 1202 starts counting the pulse signals output by the encoder 1225. In a case wherein the reflective sensor 1224 does not detect the printing medium SH although the number of pulses counted has reached a value that should be obtained before the leading edge of the printing medium SH arrives at the downstream light transmission window 702D, it is determined that a paper jam has occurred (YES at S016). Furthermore, in a case wherein a pulse signal is not output by the encoder 1225 after the printing operation has begun, or a case wherein the number of pulse signals that corresponds to predetermined elapsed time is not obtained although the predetermined time has been elapsed from the start of the printing operation, it is also determined that a paper jam has occurred (YES at S016).

When it is ascertained at step S013 that a paper jam has occurred, driving of the conveying drive motor 115 is halted, and an error message is displayed on the display device 1232. Following this, the print head H is moved to the elevated position, or the standby position (S018), and when the conveying lever 304 is thereafter pulled up (YES at S019), the supply of power to the conveying unit 103 is cut off (S020), and a message indicating the effect that the conveying unit 103 is ready for being extracted is displayed on the display device 1232 (S021).

FIG. 18 is a flowchart showing the control operation performed for determining whether the rolled printing medium SH in the feeding part 118 has been exhausted, and therefore, an error indicating exhaustion of the printing medium SH is detected, and the control operation performed when an error indicating exhaustion of the printing medium SH has occurred. In FIG. 18, the same step numbers are provided for the same processes as those in FIG. 17. Upon receiving print data transmitted by the host PC 1213 (S111), the CPU 1202 drives the conveying drive motor 115 (S112) to initiate the feeding operation and the conveying operation for the printing medium SH. Then, based on the signal output by the reflective sensor 1222 and the output of the encoder 1223, the CPU 1202 determines whether the roll of the printing medium SH at the spool of the feeding part 118 is exhausted (S113). Specifically, the CPU 1202 counts the number of pulse signals output by the encoder 1225 that begins the conveying operation. When the number of pulse signals thus counted has reached a count value that should be obtained before the leading edge of the printing medium SH arrives at the upstream light transmission window 702U, the CPU 1202 determines whether the printing medium SH is detected by the reflective sensor 1222 (S113). When the leading edge of the printing medium SH is not detected by the reflective sensor 1222, the CPU 1202 determines that the printing medium SH in the feeding part 118 is exhausted.

In a case wherein it is ascertained that the rolled printing medium SH in the feeding part 118 is exhausted, at S014, the driving of the conveying drive motor 115 is halted, and also an error message is displayed on the display device 1232. Thereafter, program control moves to step S018 to perform the same processing as the processing at S018 to S021 in FIG. 17 performed for clearing a paper jam. When exhaustion of the printing medium SH is not detected at S113, the processing at S015 to S023 in FIG. 18 that correspond to that at S015 to S023 in FIG. 17 is performed.

As described above, according to the image forming apparatus 100 of this embodiment, when the conveying unit 103 is removed from the main body 101 of the image forming apparatus 100, the conveying unit 103 is physically and electrically, completely separated from the main body 101 and the image forming unit 102. Therefore, in the paper jam clearing operation, for example, the conveying unit 103 thus extracted can be placed in a large work area to fix a paper jam, or to replace the printing medium or other units, and the operation can be efficiently performed. Furthermore, in this embodiment, since the direction in which the conveying unit 103 is to be pulled is designated as the same direction as the conveying direction for the printing medium, the space in the widthwise direction (direction W) need not be obtained for removing the conveying unit, and the installation area to the front can be reduced. It should be noted, however, that the present invention is not limited to this embodiment, and the direction in which the conveying unit is to be pulled out can also be designated as a direction (e.g., the lateral direction) that intersects the conveying direction.

Moreover, according to a conventional image forming apparatus, a feeding part that feeds a printing medium, a conveying part that conveys the printing medium that is fed, and a discharge part that discharges the conveyed printing medium are provided as individual, different units, i.e., respectively as a feeding unit, a conveying unit and a discharge unit. As a result, the number of units included in the image forming apparatus is increased, and accordingly, the number of constituents is also increased. By contrast, for the image forming apparatus of the embodiment of this invention, the feeding part 118, the conveying part 119 and the discharge part 120 are integrally formed together to provide a single unit referred to as a conveying unit. With this arrangement, the individual parts can be formed by employing a member used in common, and the number of required parts can be reduced. Further, since the interlocking mechanism for the individual members can be simplified, the apparatus manufacturing cost can be greatly reduced, compared with the cost required for the conventional apparatus.

(Second Embodiment)

Figure 19A:
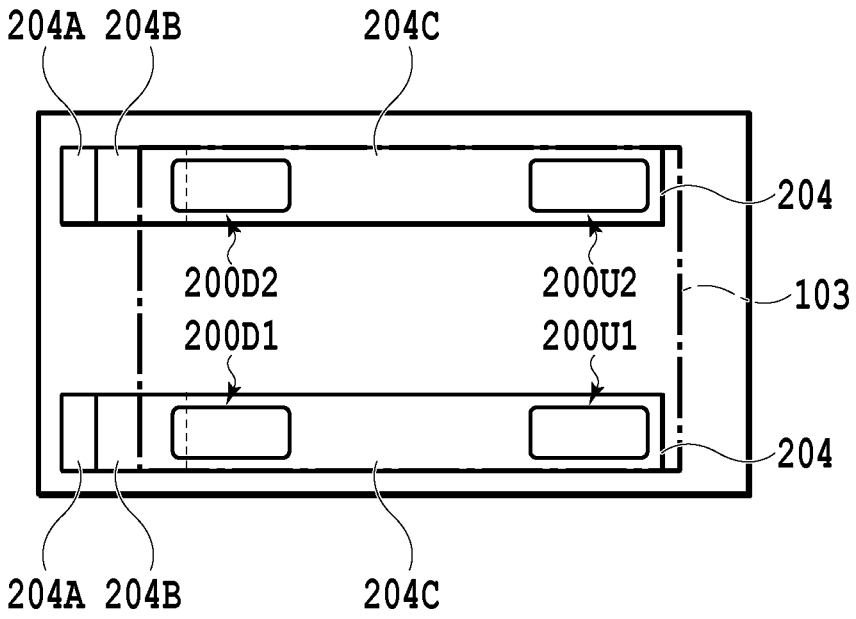
FIGS. 19A and 19B are conceptual schematic diagrams showing the arrangement and the structure for abutment mechanisms according to a second embodiment of the present invention.
Figure 19B:
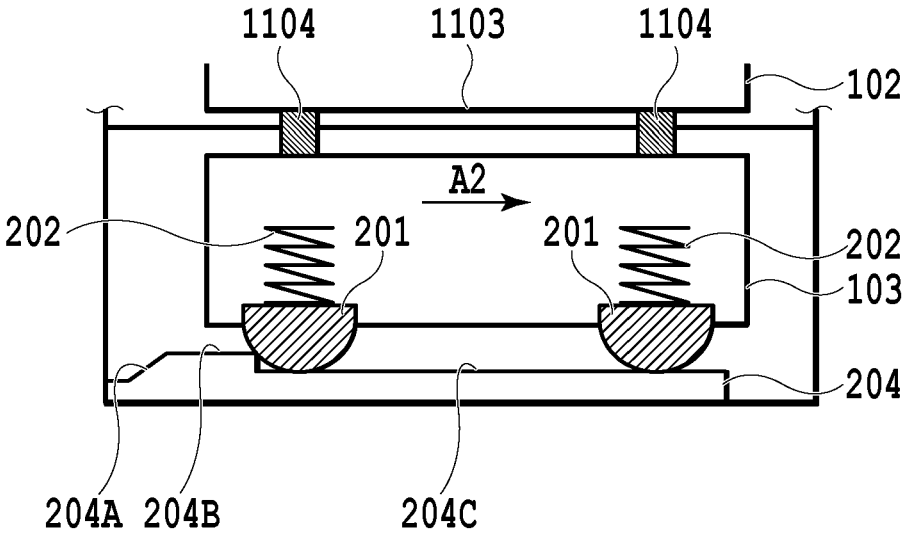

A second embodiment of the present invention will now be described based on FIGS. 19A and 19B. The same reference numerals as used for the first embodiment are employed to denote identical or corresponding components.

As shown in FIG. 19, for an image forming apparatus for the second embodiment, upstream abutment mechanisms 200U1 and 200U2 and downstream abutment mechanisms 200D1 and 200D2 are arranged at the same positions in a direction Z (at the same height). Further, two rails 204 are arranged at the bottom of a second housing 101B where a conveying unit 103 is to be accepted, and each include a slope face 204A, a raised portion 204B and a recessed portion 204C. The depths (heights) of the recessed portions 204C in the direction Z are uniform.

When the conveying unit 103 is to be inserted into the second housing 101B, the upstream abutment mechanisms 200U1 and 200U2 and the downstream abutment mechanisms 200D1 and 200D2 sequentially slide up along the slope faces 204A of the rails 204, pass the raised portions 204B and reach the recessed portions 204C. In the state wherein the conveying unit 103 is completely accepted to the second housing 101B, all of the abutment mechanisms 200 are held at the same height in contact with the recessed portions 204C. As a result, the elastic members of the individual abutment mechanisms 200 are in the same compressed state, and uniformly push up the conveying unit 103, and therefore, protruded portions 1104 formed on the upper face of the conveying unit 103 are brought in contact with the lower face of a reference plate 1103. Thus, an appropriate distance can be maintained between the ejection port face of a print head H and a platen 406 included in the conveying unit 103.

As descried above, according to the second embodiment, compared with the first embodiment, the shape of the rail is simplified, and the abutment mechanisms can be arranged at the same positions in the direction Z. Therefore, as additional effects, the arrangement can be simplified, and design layout and manufacturing can be easily performed.

(Third Embodiment)

Figure 20A:
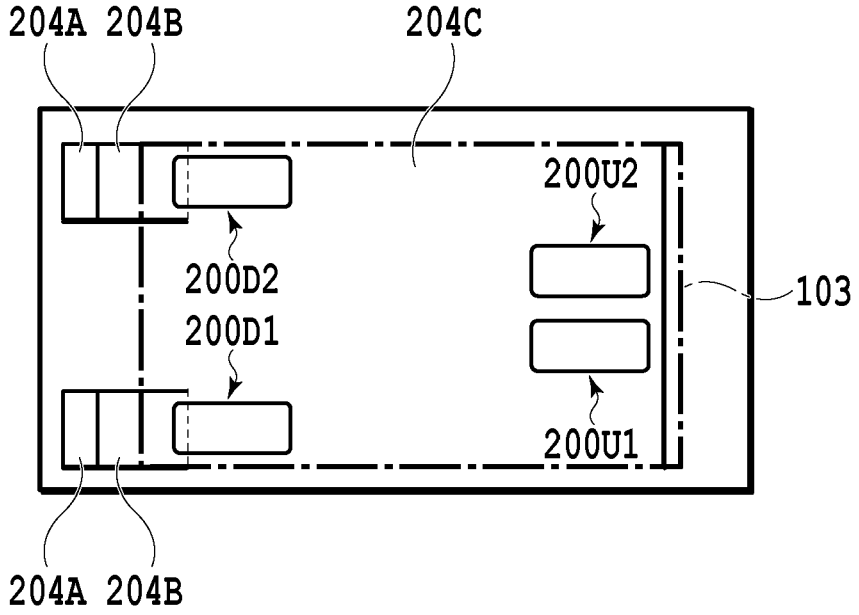
FIGS. 20A and 20B are conceptual schematic diagrams showing the arrangement and the structure for abutment mechanisms according to a third embodiment of the present invention.
Figure 20B:
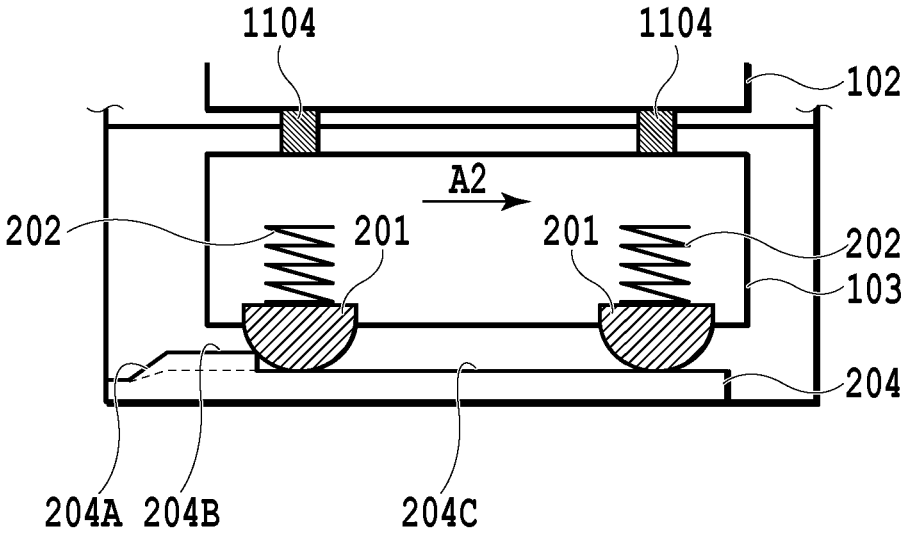

A third embodiment of the present invention will now be described based on FIGS. 20A and 20B. The same reference numerals used for the first embodiments are also employed to denote identical or corresponding components.

In the first and second embodiments, the abutment mechanisms 200U1 and 200D1 are arranged along the same linear line that is parallel to the insertion direction (direction A2), and the abutment mechanisms 200U2 and 200D2 are arranged another same linear line that is parallel to the insertion direction. That is, the distance between the abutment mechanisms 200U1 and 200U2 is equal to the distance between the abutment mechanisms 200D1 and 200D2. By contrast, according to the third embodiment, abutment mechanisms 200U1 and 200D1 and abutment mechanisms 200U2 and 200D2 are arranged so as not to be located on the same linear lines that are parallel to the insertion direction. With this arrangement, the distance between the upstream abutment mechanisms 200U1 and 200U2 is shorter than the distance between the downstream abutment mechanisms 200D1 and 200D2. As a result, the upstream abutment mechanisms 200U1 and 200U2 can pass along rails 204 at different positions in the widthwise direction from those where the downstream abutment mechanisms 200D1 and 200D2 pass.

Further, a slope face 204A, a raised portion 204B and a recessed portion 204C are formed for each of the rail portions along which the downstream abutment mechanisms 200D1 and 200D2 pass. However, for the rail portion along which the upstream abutment mechanisms 20 U1 and 200U2 pass, the raised portion 204B is not formed, and only the recessed portion 204C is formed.

Therefore, when a conveying unit 103 is to be mounted to a second housing 101B of a main body 101 for an image forming apparatus 100, the upstream abutment mechanisms 200U1 and 200U2 do not contact the raised portions 204B, and therefore, there is no moment at which the elastic members are greatly compressed. Thus, when the conveying unit 103 is to be inserted, the sliding friction caused by the abutment mechanisms against the rails, and by the reference plate and the raised portions can be reduced, and the mounting operation can be smoothly and easily performed. Further, also in this embodiment, after the conveying unit 103 has been mounted, the projected portions 1104 formed for the individual abutment mechanisms 200 are brought in contact with the reference plate 1103, so that the appropriate distance can be maintained between the ejection port face of the print head H and a platen 406. The distance between the downstream abutment mechanisms 200D1 and 200D2 may be set greater than the distance between the upstream abutment mechanisms 200U1 and 200U2. Furthermore, the abutment mechanisms 200U1, 200U2, 200D1 and 200D2 may also be arranged respectively at different locations in the widthwise direction (the direction on the conveyance plane perpendicular to the conveying direction).

(Fourth Embodiment)

Figure 21A:
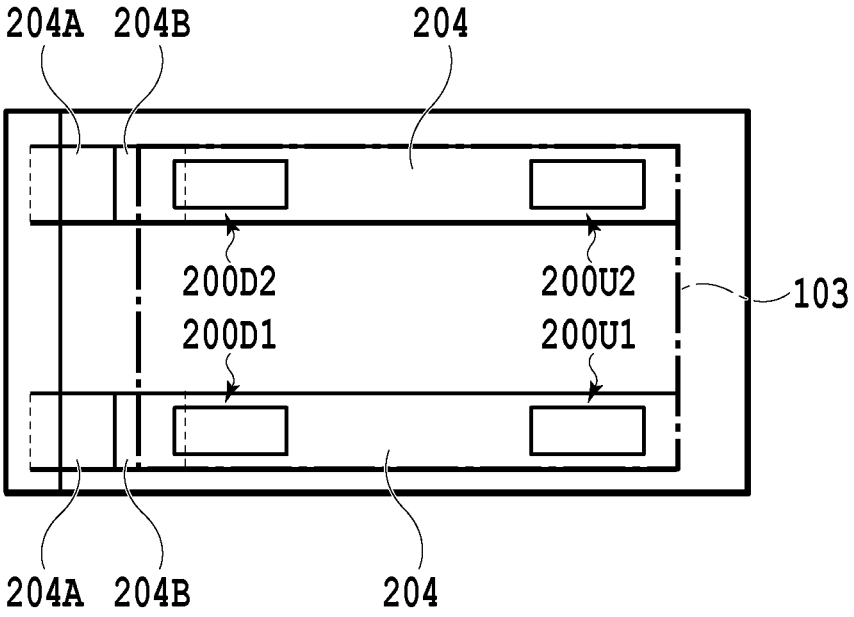
FIGS. 21A and 21B are conceptual schematic diagrams showing the arrangement and the structure for abutment mechanisms according to a fourth embodiment of the present invention.
Figure 21B:
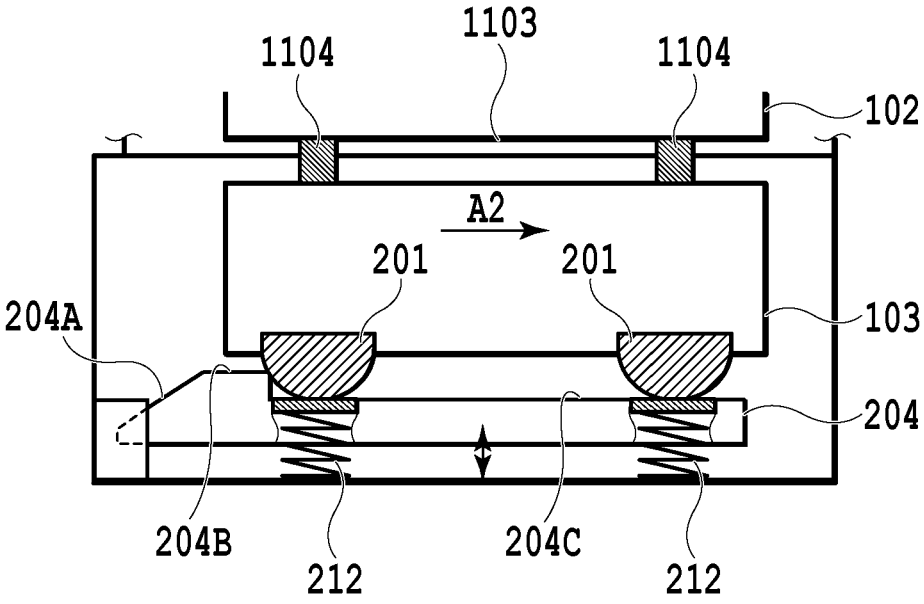

A fourth embodiment of the present invention will now be described based on FIGS. 21A and 21B. The same reference numerals used for the first embodiment are also employed to denote identical or corresponding components.

In the fourth embodiment, when abutment mechanisms 200U1, 200U2, 200D1 and 200D2 projected on the bottom face of a conveying unit 103 abut upon two rails (movable supporting members) 204, the two rails are pushed upward by elastic members 212. With this arrangement, when the conveying unit 103 is inserted into a second housing 101B of a main body 101, protruded portions 1104 of the conveying unit 1103 can be pressed against the lower face of a reference plate 1103 by the urging force of the elastic members 212 through the rails 204. Therefore, in the fourth embodiment, as well as in the other embodiments, an appropriate distance can be maintained between the ejection port face of a print head H and a platen 406.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-185325, filed on Sep. 6, 2013, which is hereby incorporated by reference herein in its entirety.

What is claimed is:

1. An image forming apparatus comprising:

a moving portion that moves a printing medium, the moving portion capable of being mounted to the image forming apparatus;

an image forming portion that ejects ink droplets to the printing medium that is moved by the moving portion, and forms an image thereon;

a reference portion mounted to the image forming apparatus so as to specify a position of the image forming portion; and a positioning portion that forces the moving portion, mounted to the image forming apparatus, to abut against the reference portion so that a distance between the moving portion and the image forming portion is a predetermined distance.

2. The image forming apparatus according to claim 1, wherein, in a state where the moving portion is mounted to the image forming apparatus, the moving portion is supported at a location below the image forming portion, and wherein the positioning portion forces the moving portion to abut against the reference portion that is designated at a low position by the image forming portion.

3. The image forming apparatus according to claim 2, wherein the positioning portion is provided on the moving portion, and in a case that the moving portion is mounted to the image forming apparatus, the positioning portion pushes the moving portion upward, and presses the moving portion against the reference portion.

4. The image forming apparatus according to claim 3, wherein the positioning portion includes:

a movable contact member that is supported to be vertically movable, while being projected downward from the moving portion, and that contacts a bottom portion of the image forming apparatus in case that the moving portion is mounted to the image forming apparatus, and an elastic member that is formed between the movable contact member and the moving portion, and that is compressed in case that the moving portion is mounted to the image forming apparatus, and generates an elastic force that pushes upward the moving portion, and presses the moving portion against the reference portion.

5. The image forming apparatus according to claim 2, wherein the positioning portion is provided on the image forming apparatus, and in case that the moving portion is mounted to the image forming apparatus, the positioning portion pushes the moving portion upward, and presses the moving portion against the reference portion.

6. The image forming apparatus according to claim 5, wherein the positioning portion includes:

a movable support member that is supported to be vertically movable, while being projected upward from the image forming apparatus, and that supports the moving portion from below when the moving portion is mounted to the image forming apparatus, and an elastic member that is formed between the movable support member and a bottom portion of the image forming apparatus, and that is compressed in a case that the moving portion is mounted to the image forming apparatus, and generates an elastic force that pushes upward the moving portion, and presses the moving portion against the reference portion.

7. The image forming apparatus according to claim 6, wherein the movable support member arranged for the positioning portion is provided as a rail extended in a direction in which the moving portion is to be inserted into the image forming apparatus.

8. The image forming apparatus according to claim 1, wherein the positioning portion is arranged at a plurality of locations.

9. The image forming apparatus according to claim 8, wherein the positioning portion is provided at a plurality of locations for the lower portion of the moving portion, and wherein the plurality of positioning portions are located along the same linear line that is parallel to a direction in which the moving portion is to be inserted into the image forming apparatus.

10. The image forming apparatus according to claim 9, wherein the positioning portion is arranged at a plurality of locations along each of two linear lines that are parallel to the direction.

11. The image forming apparatus according to claim 10, wherein the plurality of positioning portions are arranged along the same linear line, and the positioning portion located at a rear position in the direction is arranged higher than the positioning portion located in front in the direction.

12. The image forming apparatus according to claim 7, wherein the plurality of positioning portions are arranged respectively along different linear lines that are parallel to the direction.

13. The image forming apparatus according to claim 7, wherein when the moving portion is mounted to the image forming apparatus, the positioning portion exerts the elastic force of the elastic member to engage the movable contact member with an end portion of a protruded portion that is projected on an upper face of the bottom portion of the image forming apparatus, and wherein so long as a force of a predetermined level or higher is not applied to the moving portion in the direction, movement of the moving portion in the direction is prevented.

14. The image forming apparatus according to claim 1, wherein the moving portion has an arrangement by integrally forming a feeding part that feeds the printing medium from a medium supply source to a predetermined conveying path, a conveying part that conveys, along the conveying path, the printing medium that is fed from the feeding part, and a discharge part that discharges, along the conveying path, the printing medium that is conveyed by the conveying part.

15. The image forming apparatus according to claim 1, wherein the moving portion is forced to the positioning portion so as to abut against the reference portion in a state where the moving portion faces the image forming apparatus.

16. The image forming apparatus according to claim 1, wherein the positioning portion forces the moving portion to abut against the reference portion in accordance with mounting the moving portion to the image forming apparatus.

* * * * *